US006474277B1

(12) United States Patent
Vanderpoel et al.

(10) Patent No.: US 6,474,277 B1
(45) Date of Patent: Nov. 5, 2002

(54) METHOD AND APPARATUS FOR VALVE SEATING VELOCITY CONTROL

(75) Inventors: Richard Vanderpoel, Bloomfield; John A. Schwoerer, Storrs, both of CT (US)

(73) Assignee: Diesel Engine Retarders, Inc., Christiana, DE (US)

( * ) Notice: Subject to any disclaimer, the term of this patent is extended or adjusted under 35 U.S.C. 154(b) by 70 days.

(21) Appl. No.: 09/663,415

(22) Filed: Sep. 15, 2000

Related U.S. Application Data

(60) Provisional application No. 60/154,035, filed on Sep. 16, 1999, and provisional application No. 60/154,472, filed on Sep. 17, 1999.

(51) Int. Cl.[7] ..... F01L 9/02

(52) U.S. Cl. ..... 123/90.12; 123/90.15; 123/90.16; 123/90.43; 123/90.46; 123/90.55

(58) Field of Search ..... 123/90.12, 90.15, 123/90.16, 90.33, 90.36, 90.38, 90.43, 90.44, 90.46, 90.55, 188.8, 188.9, 321

(56) References Cited

U.S. PATENT DOCUMENTS

| | | | | |
|---|---|---|---|---|
| 4,206,728 A | | 6/1980 | Trenne | |
| 4,324,210 A | * | 4/1982 | Aoyama | 123/90.55 |
| 4,677,723 A | * | 7/1987 | Greene, Sr. | 123/90.46 |

(List continued on next page.)

FOREIGN PATENT DOCUMENTS

DE 3815668 A1 11/1989

OTHER PUBLICATIONS

B. Gecim. "Analysis of a Lost–Motion–Type Hydraulic System for Variable Valve Actuation," for General Motors Research.

F. Vattaneo. "Experiences with an Electrohydraulic Variable Valve Actuation System on a Four–Cylinder SI Engine," FIAT Research Center—Orbassano, Turin.

W. Gotz. "Hydraulics. Theory and Applications," Bosch–Quality Training, Robert Bosch GmbH, Ditzingen, Germany (1998).

Unknown. "3.7 Lost Motion Systems, Chapter 3 Approaches to Variable Valve Actuation," presented at University of Canterbury, New Zealand (Jul. 2, 1996).

Fortschritt–Berichte VDI. "14. Internationales Weiner Motoresymposium," Reihe 12, NR. 182, pp. 84–97, May 6–7, 1993.

Fortschritt–Berichte VDI. "7. Internationales Weiner Motoren–Symposium," Reihe 12, NR 74, pp. 221–243, Apr. 24–25, 1986.

P. Nuccio. "Variable Valve Timing as a Means to Control Engine Load," 13$^{th}$ FISITA Congress No. 71, p. 1 (1971).

* cited by examiner

*Primary Examiner*—Mark Paschall
*Assistant Examiner*—Fadi H. Dahbour
(74) *Attorney, Agent, or Firm*—David R. Yohannan; Collier Shannon Scott, PLLC

(57) ABSTRACT

A system for controlling the seating of an engine valve is disclosed. The system is designed to bring a hydraulically actuated engine valve to a soft landing on its valve seat. The velocity of the engine valve is reduced as it approaches its seat by progressively throttling the escape of hydraulic fluid from a chamber. The chamber is pressurized as a result of the valve approaching its seat. Accordingly, as the valve approaches its seat, the pressure in the chamber increases, causing the force that opposes the closing motion of the engine valve to increase.

43 Claims, 17 Drawing Sheets

U.S. PATENT DOCUMENTS 4,862,844 A 9/1989 Wakeman et al.
4,889,084 A 12/1989 Rembold
4,889,085 A 12/1989 Yagi et al.
5,109,812 A * 5/1992 Erickson et al. ..... 123/90.12
5,113,812 A 5/1992 Rembold et al.
5,127,375 A 7/1992 Bowman et al.
5,158,048 A 10/1992 Robnett et al.
5,201,290 A * 4/1993 Hu ..... 123/321
5,221,072 A 6/1993 Erickson et al.
5,259,345 A * 11/1993 Richeson ..... 123/90.12
5,275,136 A 1/1994 Schechter et al.
5,327,858 A * 7/1994 Hausknecht ..... 123/90.12
5,460,131 A 10/1995 Usko et al.
5,485,813 A 1/1996 Molitor et al.
5,511,460 A * 4/1996 Custer ..... 123/321
5,537,976 A 7/1996 Hu
5,577,468 A 11/1996 Weber
5,582,141 A 12/1996 Meyer
5,606,940 A 3/1997 Shafer et al.
5,619,964 A 4/1997 Feucht
5,829,397 A * 11/1998 Vorih et al. ..... 123/90.12
6,044,815 A * 4/2000 de Ojeda ..... 123/90.12
6,192,841 B1 * 2/2001 Vorih et al. ..... 123/90.12
6,263,842 B1 * 7/2001 De Ojeda et al. ..... 123/90.12
6,273,057 B1 * 8/2001 Schwoerer et al. ..... 123/321

METHOD AND APPARATUS FOR VALVE SEATING VELOCITY CONTROL

CROSS REFERENCE TO RELATED PATENT APPLICATIONS

This application is related to and claims priority on U.S. provisional patent application Serial No. 60/154,035 filed Sep. 16, 1999, and U.S. provisional patent application Serial No. 60/154,472 filed Sep. 17, 1999.

FIELD OF THE INVENTION

The present invention relates to the control of engine valves, such as intake and exhaust valves. In particular, the invention relates to methods and apparatus for controlling valve seating velocity.

BACKGROUND OF THE INVENTION

Engine combustion chamber valves, such as intake and exhaust valves, are almost universally of a poppet type. These engine valves are typically spring loaded toward a valve closed position. In many internal combustion engines the engine cylinder intake and exhaust valves may be opened and closed by fixed profile cams in the engine, and more specifically by one or more fixed lobes which may be an integral part of each of the cams. The use of fixed profile cams makes it difficult to adjust the timings and/or amounts of engine valve lift to optimize valve opening times and lift for various engine operating conditions, such as different engine speeds.

A variety of systems exist to regulate the timing of engine valve opening by controlling the hydraulic pressure that acts on a slave piston which actuates the engine valve. These systems include "common rail" systems in which a solenoid control valve opens a path from a source of high pressure fluid to the top of the slave piston at precise times. One such common rail system is described in Cosma et al., U.S. Pat. No. 5,619,964, assigned to the assignee of the present application.

Another method of adjusting valve timing and lift, given a fixed cam profile, has been to incorporate a "lost motion" device in the valve train linkage between the valve and the cam. Lost motion is the term applied to a class of technical solutions for modifying the valve motion proscribed by a cam profile with a variable length mechanical, hydraulic, or other linkage means. In a lost motion system, a cam lobe may provide the "maximum" (longest dwell and greatest lift) motion needed over a full range of engine operating conditions. A variable length system may then be included in the valve train linkage, intermediate of the valve to be opened and the cam providing the maximum motion, to subtract or lose part or all of the motion imparted by the cam to the valve.

This variable length system (or lost motion system) may, when expanded fully, transmit all of the cam motion to the valve, and when contracted fully, transmit none or a minimum amount of the cam motion to the valve. An example of such a system and method is provided in Hu, U.S. Pat. Nos. 5,537,976 and 5,680,841, which are assigned to the same assignee as the present application and which are incorporated herein by reference.

In the lost motion system of U.S. Pat. No. 5,680,841, an engine cam shaft may actuate a master piston which displaces fluid from its hydraulic chamber into a hydraulic chamber of a slave piston. The slave piston in turn acts on the engine valve to open it. The lost motion system may include a solenoid valve and a check valve in communication with the hydraulic circuit including the chambers of the master and slave pistons. The solenoid valve may be maintained in a closed position in order to retain hydraulic fluid in the circuit. As long as the solenoid valve remains closed, the slave piston and the engine valve respond directly to the motion of the master piston, which in turn displaces hydraulic fluid in direct response to the motion of a cam. When the solenoid is opened temporarily, the circuit may partially drain, and part or all of the hydraulic pressure generated by the master piston may be absorbed by the circuit rather than be applied to displace the slave piston.

Another example of an engine valve actuator is disclosed in U.S. Pat. No. 5,186,141, "engine Brake Timing Control Mechanism," issued to D. Custer on Feb. 16, 1993 (the "'141 patent"), incorporated by reference herein. The actuator disclosed in the '141 patent does not provide for engine valve seating control, although it could benefit from such control.

Engine valves are required to open and close very quickly, therefore the valve spring is typically very stiff. When the valve closes, it may impact the valve seat with such force that it eventually erodes the valve or the valve seat, or even cracks or breaks the valve. In mechanical valve actuation systems that use a valve lifter to follow a cam profile, the cam lobe shape provides built-in valve-closing velocity control. In common rail hydraulically actuated valve assemblies, however, there is no cam to self-dampen the closing velocity of an engine valve. Furthermore, in some lost motion applications the engine valve needs to be closed at an earlier time than that provided by the cam profile. This earlier closing may be carried out by rapidly releasing hydraulic fluid to an accumulator in the lost motion system. In hydraulic lost motion systems, a rapid draining of fluid from the slave piston may allow an engine valve to "free fall" and seat with an unacceptably high velocity. Free fall results when the rate of closing the engine valve is governed by the hydraulic fluid flow to the accumulator instead of by the fixed cam profile. Engine valve seating control may also be required for applications (e.g. centered lift) in which the engine valve seating occurs on a high velocity region of the cam. Electromagnetic valve actuation may also require valve seating control.

As a result of the foregoing there is a need to limit valve seating velocities. The need for limited valve seating velocities conflicts with the need for rapid valve opening rates. Some attempts have been made to solve the problem by providing separate fill and drain ports for slave pistons. U.S. Pat. No. 5,577,468 discloses one system for limiting valve seating velocity. Existing methods for controlling engine valve seating velocity may be costly, inaccurate, and cause excessive valve closing variations. Existing systems also fail to accommodate the need for adjustments due to variations in engine valve lash between cylinders.

Applicants approached the valve seating challenge with the understanding that valve seating velocity should be less than approximately 15 in/sec (0.38 m/sec). Absent steps to control valve seating velocity, the valves could seat at a velocity that is an order of magnitude greater. Applicants also determined that valve seating control preferably should be designed to function when the closing valve gets within 0.5 to 0.75 mm of the valve seat. The combination of valve thermal growth, valve wear, and tolerance stack-up can exceed 0.75 mm, resulting in the complete absence of seating velocity control or in an exceedingly long seating event if measures are not taken to adjust the lash of the valve seating control to account for such variations. It is also assumed that, preferably, valve seating control should not significantly reduce initial engine valve opening rate, and valve seating control should be capable of operating over a wide range of valve closing velocities and oil viscosities.

Valve catch devices used to control valve seating velocity may use hydraulic fluid flow restriction to produce pressure that acts on an area of the slave piston to develop a force to slow the slave piston and reduce seating velocity. The area on which the pressure acts may be very small in such devices which in turn requires that the pressure opposing the valve return spring be high, and the controlling flow rate be low. Low controlling flow rates result in an increased sensitivity to leakage and manufacturing tolerances. In addition, these devices may restrict the hydraulic fluid flow that produces valve opening.

A known valve catch (seating) system developed to provide valve seating control is disclosed in co-pending U.S. patent application Ser. No. 09/383,987, filed Aug. 26, 1999, hereby incorporated by reference and which is shown as system 100 in FIG. 1. The system 100 includes a slave piston 120 disposed within an actuator housing 110. The slave piston 120 is slidable within the housing 110 so that it may open an engine valve (not shown) below it. A screw body 130 extends through the top of the housing 110 and abuts against the slave piston 120 when the latter is in a resting position (i.e. engine valve closed). A plunger 140 is disposed within the screw body 130 and is biased towards the slave piston 120 by a spring 160. The screw body 130 may be twisted into and out of the housing 110 to manually adjust engine valve lash.

The plunger 140 serves to selectively limit valve seating velocity as the slave piston 120 approaches its home position (engine valve closed), thereby allowing the engine valve to close more gently than it otherwise might. The plunger 140 is mechanically limited from extending beyond the screw body 130 by more than a preset distance, thus allowing the slave piston 120 to return rapidly until contacting the plunger.

The system 100 operates under the influence of hydraulic fluid provided through a passage 150 in the housing 110. Preferably, the hydraulic fluid provided by the passage 150 is high pressure. During the downward (valve opening) displacement of the slave piston 120, hydraulic fluid flows through the passage 150 in the housing 110 and through the passages in the slave piston so that the slave piston is forced downward against the engine valve. During the upward (valve closing) displacement of the slave piston 120, the hydraulic fluid flows back through the passages in the slave piston 120 and out of the passage 150 in the housing 110. As the slave piston 120 approaches its home position, it forms a seal with the plunger 140. The seal between the plunger 140 and the slave piston 120 results in the building of hydraulic pressure in the space between the slave piston and the end wall of the housing 110 as the slave piston progresses towards its home position. The building hydraulic pressure opposes the upward motion of the slave piston 120, thereby slowing the slave piston and assisting in seating the engine valve.

While the valve catch system 100 shown in FIG. 1, which works on slave piston pressure, has achieved acceptable valve seating velocity over a wide range of engine speeds and oil temperatures, improvements are still needed. For example, the valve catch system 100 tends to hold the engine valve open longer than is desirable for optimum engine breathing at high engine speeds. The system is also prone to reduce valve velocity to nearly zero prior to seating and thereafter accelerate the valve so that it seats at an unacceptable velocity. This type of valve catch system also may require a complicated slave piston design, which increases high-pressure volume, increases the length and flow resistance of the fluid path between the slave piston and the passages leading to the master piston, trigger valve, or plenum, and increases the required slave piston height and weight. Increased high-pressure volume may be detrimental to compliance. Increased flow path length and flow resistance provide increased pressure drop and therefore increased parasitic power and oil cooling load. Additionally, increased pressure drop may make it difficult to maintain master piston pressure greater than ambient during periods of decreasing cam displacement during high engine speed, which may allow air bubbles to form in the oil.

A second valve catch system 200 is disclosed in the co-pending 09/383,987 application referenced above, and is shown in FIG. 2. The valve catch system 200 works on valve catch plenum pressure, and is considered to have lower parasitic loss than the system shown in FIG. 1. The system 200 includes a slave piston 220 disposed within an actuator housing 210. The slave piston 220 is slidable within the housing 210 so that it may open an engine valve (not shown) below it. A screw body 230 extends through the top of the housing 210 and abuts against the slave piston 220 when the latter is in a resting position (i.e. engine valve closed). A plunger 240 is disposed within the screw body 230 and biased towards the slave piston 220 by a spring 260. The screw body 230 may be twisted into and out of the housing 210 to adjust engine valve lash. A fluid passage 250 through the housing 210 leads to a high pressure hydraulic source such as a master piston (not shown) and/or a trigger valve (not shown).

The system 200 operates similarly to the system 100 shown in FIG. 1, except that the hydraulic pressure that opposes the upward movement of the slave piston 220 is built inside the screw body 230. Although performance may be improved using the system 200, compliance difficulties may still be encountered due to the high pressures required and the increased compliance associated with the smaller area of plunger 240.

In view of the foregoing there is a need for a system for valve seating control that operates well in a high pressure regime requiring fine control of hydraulic fluid flow through the system. There is also a need for a system that does not adversely effect hydraulic fluid flow for valve opening and which is less susceptible to leakage sensitivity. In particular, there is a need for valve seating that is improved by a flow control that becomes more restrictive as the valve approaches the seat.

There is also a need for a valve catch that adjusts for lash differences between the engine valve and the valve catch. Although most variable valve actuation (VVA) systems are inherently self lash adjusting, valve seating control is not. Systems that do not need manual adjustment, either initially, or as the system ages, are desirable. Previous valve seating control mechanisms have required a manual lash adjustment or a separate set of lash adjustment hardware. The design of a conventional hydraulic lash adjustor capable of transmitting compression-release braking loads would be challenging due to structural and compliance requirements.

Unlike the valve catch systems 100 and 200 shown in FIGS. 1 and 2, the various valve catch embodiments of the present invention include a variable area orifice in the system plunger. Accordingly, the various valve catch embodiments of the invention may have reduced parasitic power loss and consequently reduced VVA housing cooling load, and reduced slave piston length and weight as compared with previous valve catch systems. The valve catch embodiments of the present invention may also experience reduced peak valve catch pressure as compared with the previous valve catch systems. Furthermore, the variable flow restriction design of the valve catch embodiments of the present invention is expected to be more robust than the constant flow restriction design in terms of engine valve velocity control at the point of valve catch engagement, and in terms of oil temperature and aeration control. Variable flow restriction may allow the displacement at the point of valve catch/slave piston engagement to be reduced, so that the valve catch has less undesired effect on the breathing of the engine.

The present invention meets the aforementioned needs and provides other benefits as well. The claimed invention provides acceptable engine valve seating velocity in a VVA system, such as a lost motion or common rail system. For a lost motion VVA system, engine valve seating control is provided for early engine valve closing, where the rate of closing is governed by the hydraulic flow from the slave piston to the accumulator as opposed to a cam profile. Engine valve seating control also may be provided for a high velocity region of the cam and/or for common rail VVA designs.

The valve seating velocity control provided by this invention also may be applied to camless variable valve actuation designs in which the engine valve is not spring loaded toward a valve-closed position. One example is the electromagnetic concept (Aura, FEV, BMW, Daimler Benz, Siemens) in which there are opposing springs acting in both the valve closed and valve open directions, in order to create an oscillating spring-mass system, and two solenoids, which latch the valve in either the closed or full-open position. In this system, valve seating velocity control could be provided by precisely controlling the current to the solenoids; however, in practice, a separate valve seating control device may be required to assure acceptable valve seating under all conditions. Another example is the electrohydraulic common rail concept (Ford) in which there are no valve springs and two high-speed solenoid valves are used to alternately connect a source of high-pressure hydraulic fluid and drain to either side of a piston connected to the engine valve. In this system, valve seating velocity control could be provided by precisely controlling the timing of the high-speed solenoid valves; however, in practice, a separate valve seating control device may be required to assure acceptable valve seating under all conditions.

OBJECTS OF THE INVENTION

It is therefore an object of the present invention to provide a method and system for controlling valve seating.

It is a further object of the present invention to provide a method and system for controlling valve seating that operates well under high hydraulic pressure.

It is another object of the present invention to provide a method and system for seating an engine valve with fine control over valve seating velocity.

It is yet a further object of the present invention to provide a method and system for controlling valve seating that is less likely to adversely affect hydraulic fluid flow for valve opening.

It is still another object of the present invention to provide a method and system for controlling valve seating that progressively restricts hydraulic fluid flow as the valve approaches its seat.

It still yet another object of the present invention to provide a method and system for controlling valve seating velocity that is self lah adjusting for valve thermal growth, valve wear, and tolerance stack-up.

It is yet another object of the present invention to provide a method and system for valve seating control that provides a nearly constant deceleration of the valve before seating.

It is still yet a further object of the present invention to provide a method and system for valve seating control that provides acceptable seating velocity during early valve closing events.

It is still another object of the present invention to provide a method and system for valve seating control that provides acceptable seating velocity during centered lift events when the valve seats on a high velocity section of the cam.

It is still another object of the present invention to provide a method and system for valve seating control that reduces the volume of hydraulic fluid in the master-slave piston circuit in order to reduce system compliance.

It is a further object of the present invention to provide a method and system for valve seating control with reduced parasitic loss and consequently reduced cooling requirements.

It is another object of the present invention to provide a method and system for valve seating control with improved hydraulic fluid aeration characteristics.

It is still another object of the present invention to provide a method and system for valve seating control that utilizes a slave piston of reduced length and weight as compared to previous systems.

It is still a further object of the present invention to provide a method and system for valve seating control of relatively simple and low cost design.

It is still a further object of the present invention to provide a method and system for reliable valve seating.

It is another object of the present invention to provide a method and system for controlled seating velocity over a wide range of valve closing velocities.

It is still another object of the present invention to provide a method and system for controlled seating velocity over a wide range of oil viscosities.

It is still a further object of the present invention to provide a method and system for valve seating control that does not require closely held concentricity of the control elements.

It is still a further object of the present invention to provide a method and system for valve seating control that includes a means to dissipate the heat generated during valve seating.

Additional objects and advantages of the invention are set forth, in part, in the description which follows and, in part, will be apparent to one of ordinary skill in the art from the description and/or from the practice of the invention.

It is a further object of the present invention to provide a method and system for valve seating control that does not require closely held concentricity of the control elements.

It is a further object of the present invention to provide a method and system for valve seating control that includes a means to dissipate the heat generated during valve seating.

SUMMARY OF THE INVENTION

In response to the foregoing challenges, Applicants have developed an engine valve seating system having a piston adapted to be bi-directionally displaced in response to the filling and draining of hydraulic fluid from an hydraulic chamber in communication with the piston, the system comprising means for guiding hydraulic fluid from the chamber during draining; and means for throttling hydraulic fluid flow through the guiding means at a preselected rate in response to a change in position of the guiding means relative to the throttling means during draining.

Applicants have additionally developed a system for controlling seating velocity of an internal combustion engine valve comprising a housing having a bore formed therein for receipt of a piston; a piston positioned in and adapted for bi-directional displacement in the bore; an hydraulic chamber defined by an end of the piston; a piston stop extending into the chamber; and a disk having at least a central opening, the disk positioned in the chamber and being adapted to cooperate with the piston stop to control valve seating velocity.

Applicants have additionally developed a system for controlling seating velocity of an internal combustion engine valve comprising a housing having a bore formed therein for receipt of a piston, and a recess formed in an end wall of the bore; a recess shoulder formed along the intersection of the recess and the bore; a piston positioned in and adapted for bi-directional displacement in the bore; an hydraulic chamber defined by the bore end wall and the piston; means for providing hydraulic fluid flow to and from the chamber; a disk having at least a central opening, said disk positioned between the piston and the bore end wall; a spring adapted to bias the disk against the recess shoulder when the piston is in a retracted position; and an elongated stop having a fluted end extending from the piston, through the chamber, through the disk, and into the recess, wherein a minimized hydraulic passage is formed between the disk and the elongated stop when the piston is in the retracted position.

Applicants have additionally developed a system for controlling seating velocity of an internal combustion engine valve comprising a housing having a bore formed therein for receipt of a piston; a piston positioned in and adapted for bi-directional displacement in the bore, the piston having a recess formed in an upper end thereof; an hydraulic chamber defined by an end wall of the bore and the upper end of the piston; a recess shoulder formed along the intersection of the recess and the chamber; a disk having a central opening, the disk positioned between the piston and the bore end wall; a spring adapted to bias the disk against the recess shoulder when the piston is in a retracted position; and an elongated stop having a fluted end extending from the bore end wall, through the chamber, through the disk, and into the recess, wherein a minimized hydraulic passage is formed between the disk and the elongated stop when the piston is in the retracted position.

Applicants have also developed a method of controlling the seating velocity of an engine valve comprising the steps of filling a fluid chamber responsive to an opening motion of the engine valve; expulsing fluid from the fluid chamber responsive to a closing motion of the engine valve; and progressively throttling the expulsion of fluid from the fluid chamber during at least a portion of the engine valve closing motion.

Applicants have additionally developed a method of controlling the seating velocity of an engine valve and providing automatic lash take up, the said method comprising the steps of providing leakage filling of a first fluid chamber to automatically take up lash; filling a fluid chamber responsive to an opening motion of the engine valve; expulsing fluid from the fluid chamber responsive to a closing motion of the engine valve; and progressively throttling the expulsion of fluid from the fluid chamber during at least a portion of the engine valve closing motion.

BRIEF DESCRIPTION OF THE DRAWINGS

Various embodiments and elements of the invention are shown in the following figures, in which like reference numerals are intended to refer to like elements.

DETAILED DESCRIPTION OF THE INVENTION

Figure 3:
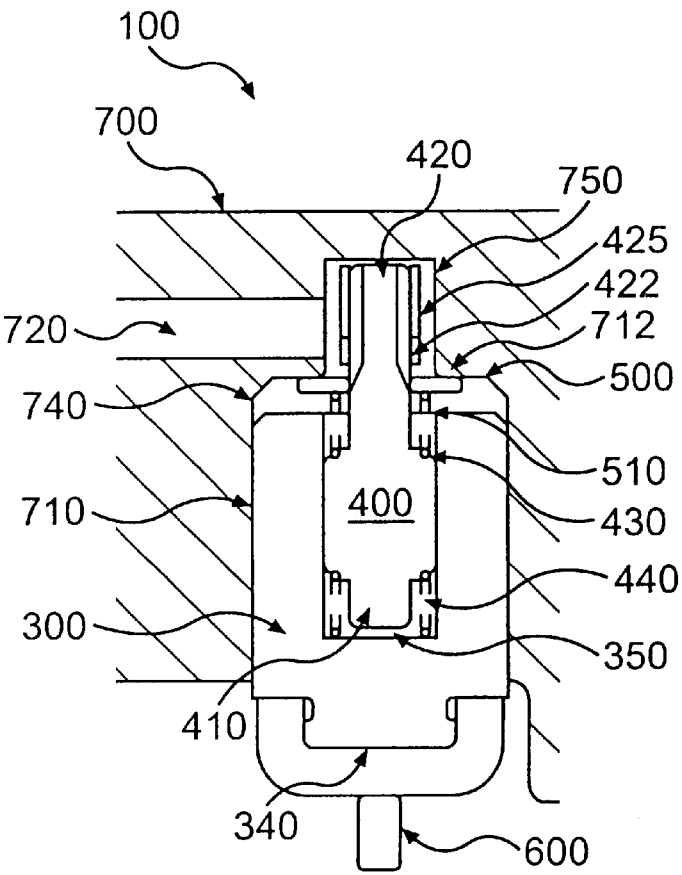
FIG. 3 is a cross-section in elevation of a first embodiment of the present invention.

Reference will now be made in detail to a first embodiment of the present invention, an example of which is illustrated in the accompanying drawings. With reference to FIG. 3, a first embodiment of the self adjusting valve catch (SAVC) may be provided with engine oil in much the same manner as the camshaft journals. The SAVC 100 comprises a housing 700, a slave piston 300, an elongated stop 400, and a disk 500.

The housing 700 includes a housing bore 710 in which the slave piston 300 is slidably disposed. A hydraulic fill/drain port 720 through the housing 700 comprises a means for providing hydraulic fluid to and from the housing bore 710. A recess 750 is provided in the end wall 712 of the housing 700. The recess 750 receives the fluted end 420 of the elongated stop 400 when the slave piston 300 is in a retracted position. The recess 750 may open on the chamber 740 defined by the end wall 712, the housing bore 710, and the slave piston 300.

The slave piston 300 may be generally cylindrically shaped such that it is capable of forming a sliding seal with the housing bore 710. The slave piston 300 may include a chamber or recess 350 extending into the slave piston from the upper end there. The lower end 340 of the slave piston 300 may be adapted to contact a contact stem 600, an engine valve stem, or a valve bridge (not shown).

The elongated stop 400 may be cylindrically shaped with a non-fluted end 410, and a fluted end 420. An elongated stop shoulder 430 is formed at the intersection of the non-fluted end 410 and the fluted end 420. The non-fluted end 410 of the elongated stop is disposed within the slave piston recess 350. A spring 440 is placed in compression between the non-fluted end 410 and the bottom of the slave piston recess 350. The fluted end 420 extends into the housing recess 750 when the slave piston 300 is in its retracted position.

The fluted end 420 includes one or more flutes 422 which provide a means for guiding hydraulic fluid to and from the chamber 740. The flutes 422 may be of a uniform or non-uniform depth along the length of the fluted end 420. In a preferred embodiment of the invention, the flutes 422 are tapered to have a progressively decreased depth as the flutes near the non-fluted end 410 (see FIG. 7). The taper is shown as linear, but may be non-linear to accomplish the desired seating velocity in alternative embodiments. A cap 425 may be positioned over the fluted end 420. The 10 cap 425 may be connected to the elongated stop by a crimp/swage, press fit joint, or a pinned joint.

Figure 9:
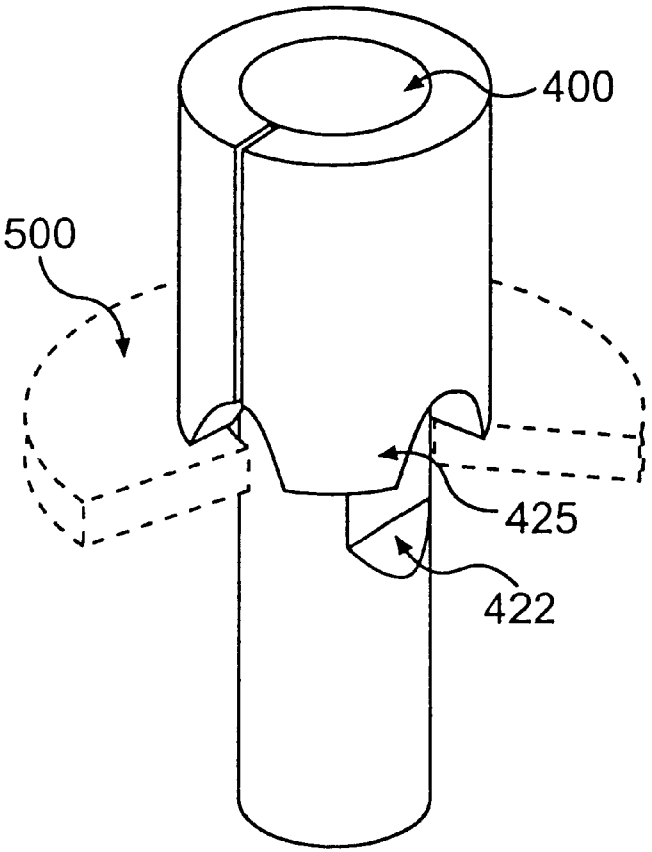
FIG. 9 is a pictorial view of one means of limiting the motion of the check disk relative to the control pin for use in the first embodiment of the present invention.

The relationship of the cap 425 to the elongated stop is illustrated in FIG. 9.

The disk 500 is provided with a central bore adapted to receive the fluted end 420 of the elongated stop. The central bore in the disk 500 makes it self-aligning on the fluted end 420, thereby simplifying assembly. The diameter of the central bore is selected relative to that of the fluted end 420 so that a minimum flow area may be formed between the fluted end and the disk 500. The spring 510 biases the disk 500 towards the end wall 712. In this embodiment the disk 500 seats at a predetermined valve lift at which point the flow from the volume above the slave piston begins to be throttled.

Controlled valve seating is accomplished because as the slave piston 300 approaches its fully retracted position, the relative movement of the tapered end of the flutes 422 past the disk 500 throttles the flow of hydraulic fluid from the chamber 740 to the recess 750 more and more until the flow is reduced to a minimal value and the engine valve seats.

Operation of the system 100 starts with the slave piston 300 in its retracted position as shown. In this position there may be a gap between the slave piston and the valve stem, bridge, or contact stem 600. High or low pressure hydraulic fluid entering port 720 flows through flutes 422 or around disk 500 and fills the chamber 740. The low pressure hydraulic fluid in the chamber 740 causes the slave piston 300 to move down and eliminates the lash between the slave piston and the contact stem 600. The elimination of the lash initially creates a gap between the elongated stop 400 and the upper end of the housing recess 750. After this initial period, the elongated stop 400 slowly moves upward under the action of the spring 440 and eliminates this gap as a result of leakage flow into the recess 350. Leakage flow into the recess 350 provides constant self-adjusting lash take-up for the system. The elongated stop 400 can move upward until it contacts the upper end of the housing recess 750, at which point the stiff engine valve springs prevent any further motion.

During valve actuation high pressure hydraulic fluid enters the system through the port 720, unseats and flows past the disk 500, and moves the slave piston 300 downward. The disk design provides minimal throttling of the hydraulic fluid during filling of the hydraulic chamber between the bore and the slave piston.

During valve closing, hydraulic fluid is vented through the port 720, allowing the slave piston 300 to return to its retracted position. The return or seating velocity of the slave piston 300 may be controlled by the selection of the flow area between the disk 500 and the elongated stop 400, as well as by the design of the cap 425. The flow past the disk 500 on closing is initially high due to the cap 425 keeping the disk 500 unseated. Once the cap 425 moves upward enough to let the disk 500 seat, flow is controlled solely by the design of the flutes 422. The flow area is designed to be relatively large (unrestricting) when the slave piston is in an extended position. As the slave piston 300 approaches its retracted position, the flow area decreases during the last portion (e.g. >>0.75 mm) of valve lift.

Auto-lashing of the elongated stop is also provided by means of leakage to the slave piston recess 350. While the slave piston 300 and the elongated stop 400 move nearly together during valve actuation, the stop actually moves slowly upward relative to the slave piston as hydraulic fluid leaks into the slave piston recess 350. The shoulder 430 should provide a surface for the hydraulic fluid in the hydraulic chamber 740 to act on the stop 400 to keep the stop moving with the slave piston 300 in the presence of inertial forces.

The net upward displacement of the elongated stop 400 relative to the slave piston 300 caused by the leakage of hydraulic fluid into the slave piston recess 350 (typically 0.025 mm) may cause the elongated stop 400 to contact the housing 700 before the slave piston 300 is fully retracted. The relatively small diameter of the elongated stop 400 produces high pressure in the slave piston recess 350. The upward pressure of the valve spring (not shown) on the elongated stop 400 squeezes the hydraulic fluid in the slave piston recess 350 back out until the slave piston 300 is fully retracted. The process of squeezing the extra hydraulic fluid out of the slave piston recess 350 provides additional valve seating velocity control over the last few hundredths of a millimeter of valve closure.

Figure 7:
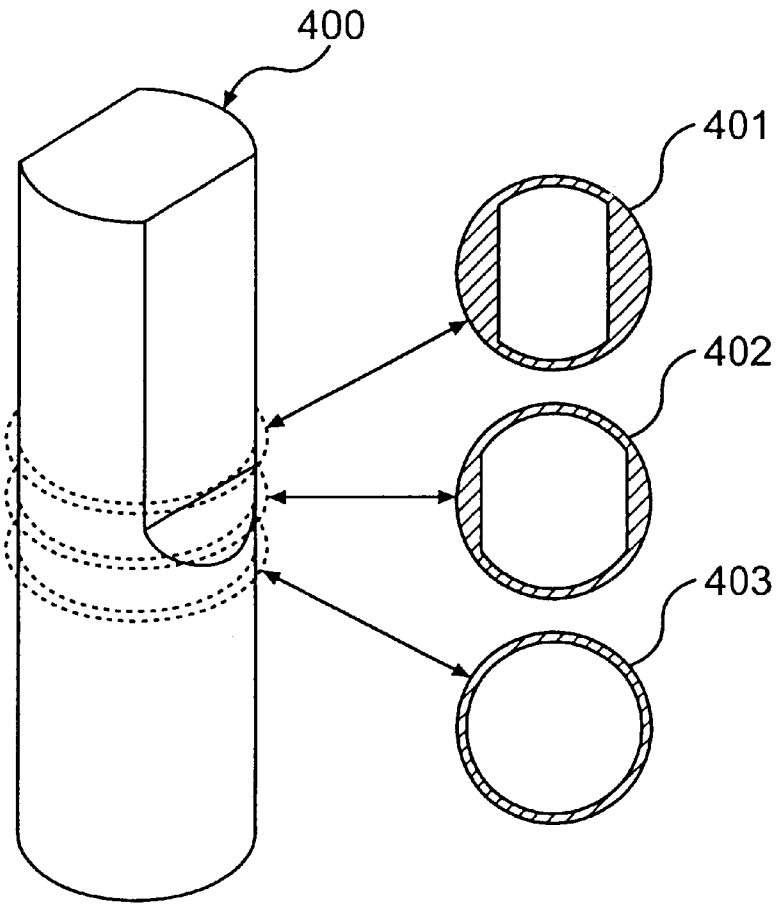
FIG. 7 is a pictorial view of an elongated stop or control pin with two flutes implemented as flat s for u se in the first embodiment of the present invention.

With continued reference to FIG. 3, the fluted end 420 of the elongated stop 400 may include two flutes 422. It is recognized that the number, length, depth, and taper angle of the flutes 422 may be varied without departing from the scope of the invention. In fact, the flutes 422 may constitute flat portions, or "flats," on the elongated stop 400, as shown in FIG. 7.

Figure 1:
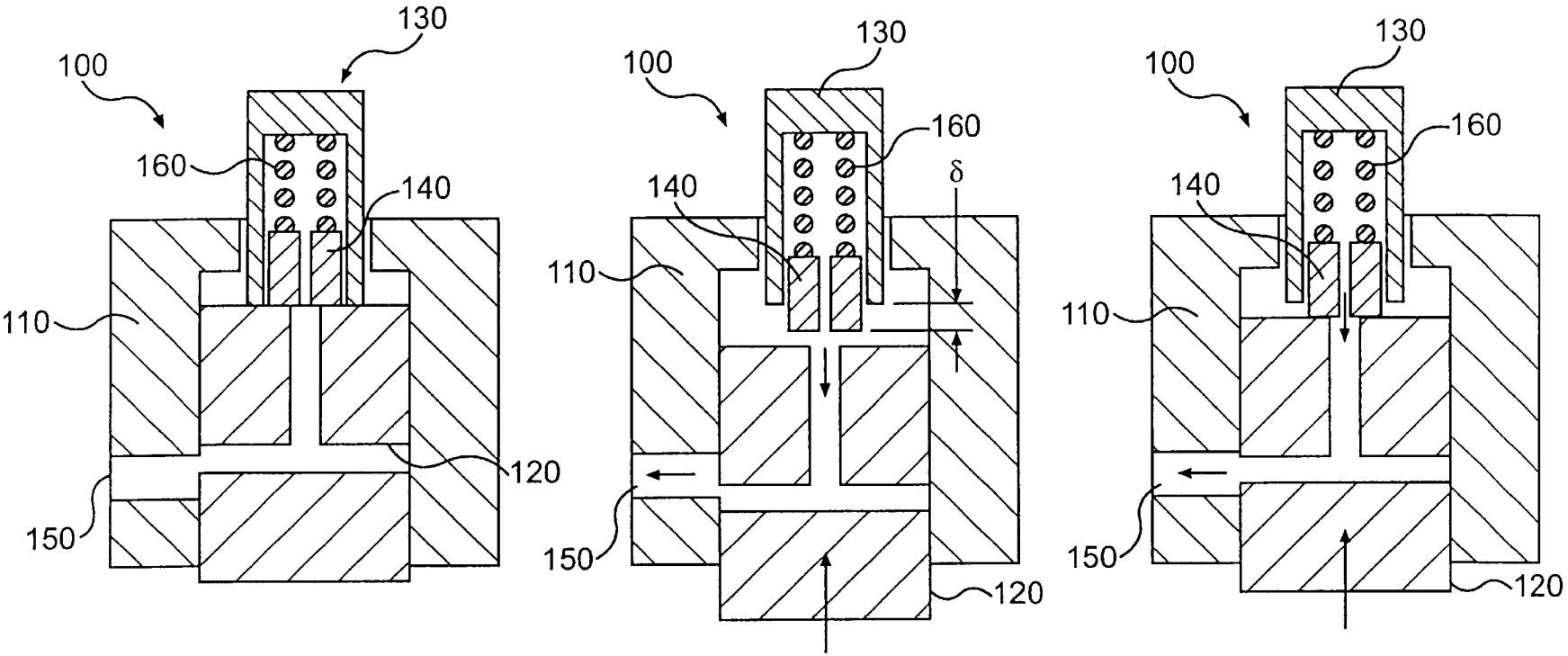
FIG. 1 is a cross-section in elevation of a valve catch design disclosed in a co-pending application assigned to the assignee of the present application.
Figure 2:
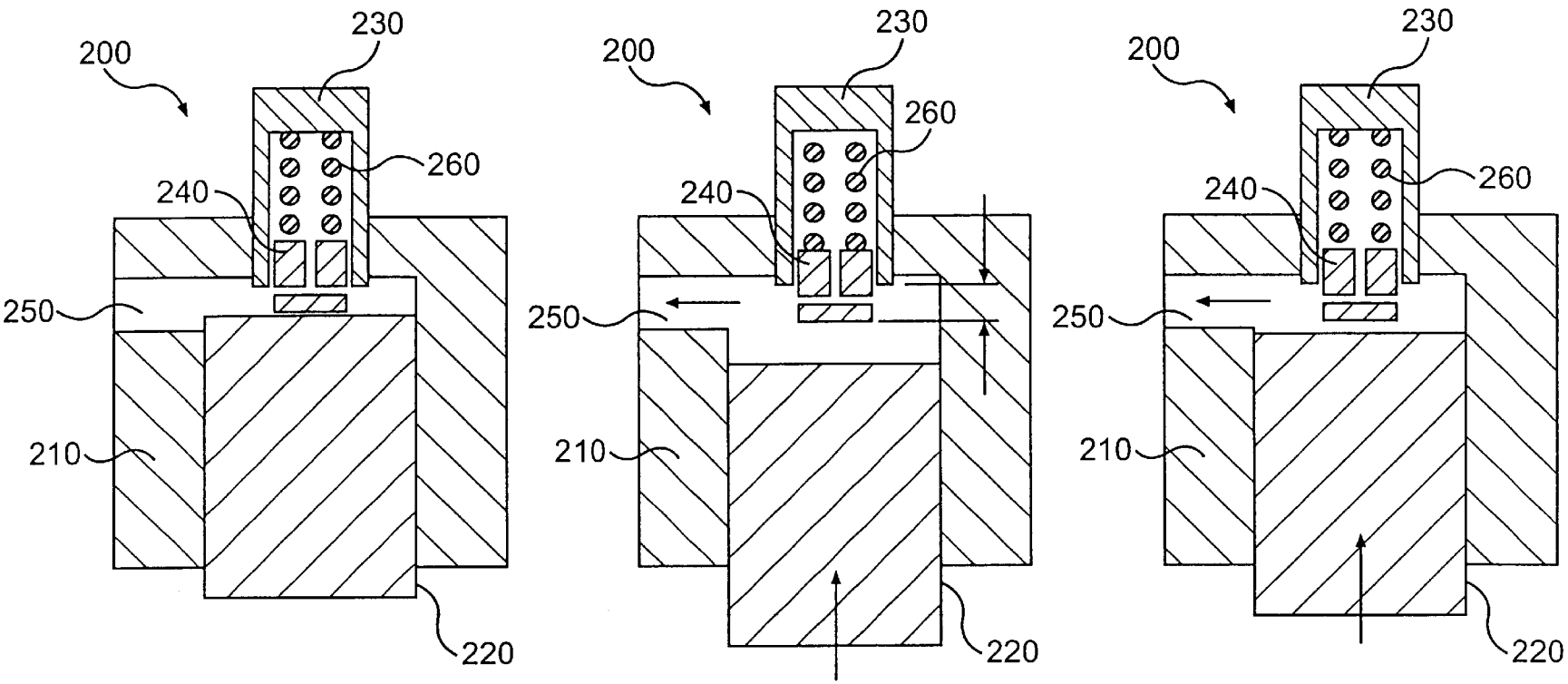
FIG. 2 is a cross-section in elevation of a second valve catch design disclosed in a co-pending application assigned to the assignee of the present application.
Figure 4:
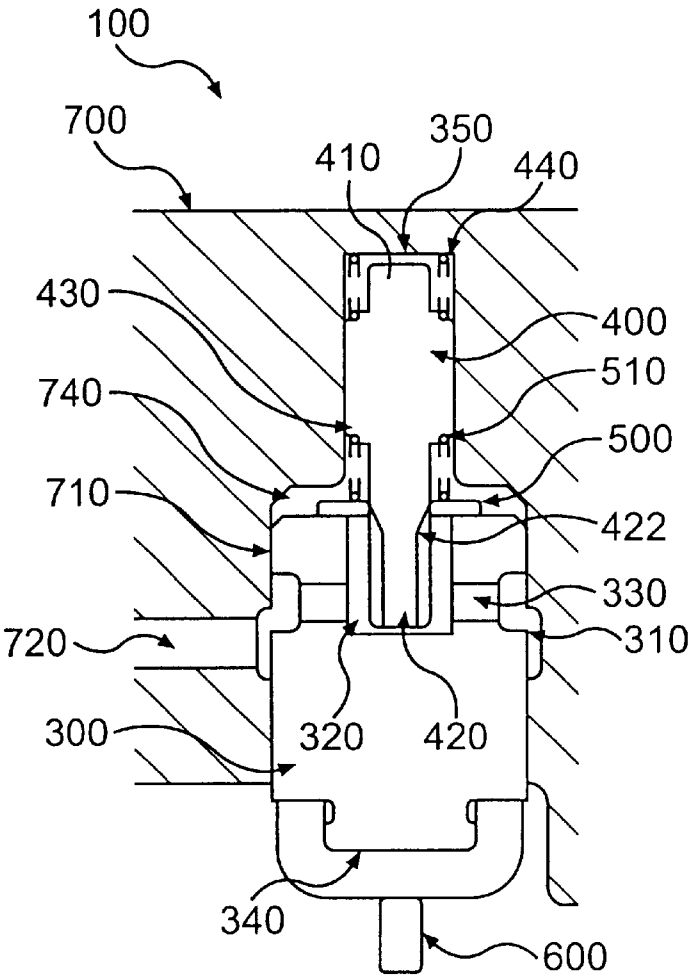
FIG. 4 is a cross-section in elevation of a second embodiment of the present invention.

With reference to FIG. 4, in which like reference numerals refer to like elements, a system 100 similar to that shown in FIG. 3 is disclosed. The system shown in FIG. 4 includes an inverted elongated stop 400 as compared to the system of FIG. 3. An explanation of the operation of the system shown in FIG. 4 is apparent from the following explanation of the operation of the system 100 shown in FIG. 5.

Figure 5:
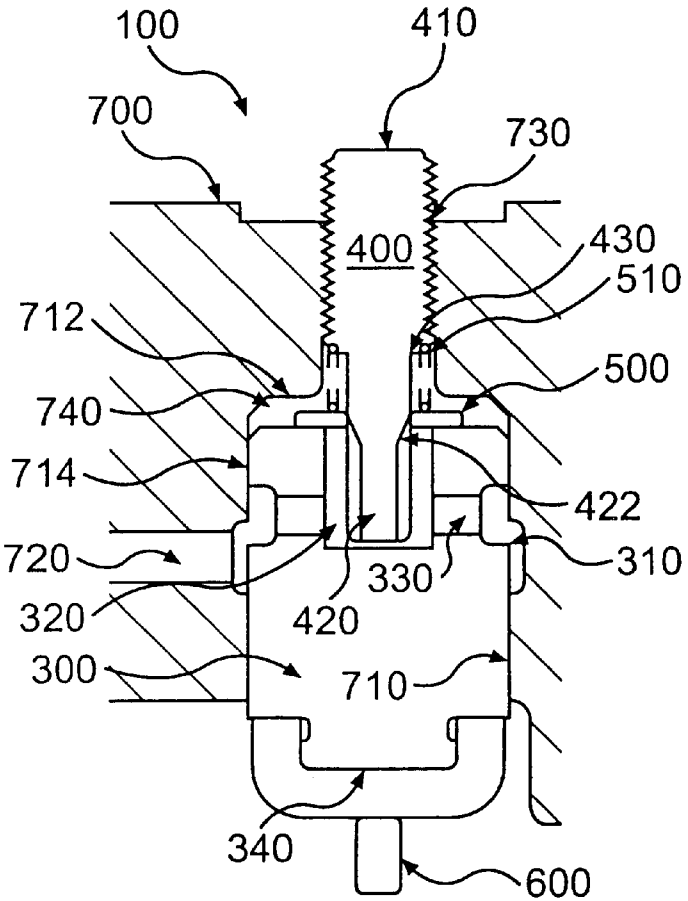
FIG. 5 is a cross-section in elevation of a third embodiment of the present invention.

With reference to FIG. 5, in which like reference numerals refer to like elements in the other figures, a system 100 for valve actuation and valve seating control in accordance with a third embodiment is shown. The system 100 comprises a housing 700, a slave piston 300, an elongated stop integrated into a lash adjusting screw 400, and a disk 500. The system 100 shown in FIG. 5 may be combined with an external lash take up device (not shown).

The housing 700 includes a housing bore 710 in which the slave piston 300 is slidably disposed. A hydraulic fill/drain port 720 through the housing 700 comprises a means for providing hydraulic fluid to and from the housing bore 710. The housing 700 may also have a threaded opening 730 for receipt of the elongated stop 400. The threaded opening 730 may extend through the wall of the housing 700 so that it opens on a chamber 740 defined by the end wall 712 and the side wall 714 of the housing bore 710.

The slave piston 300 may be cylindrically shaped such that it is capable of forming a sliding seal with the housing bore side wall 714. The slave piston 300 may include a peripheral indent 310, a recess 320 in the upper end of the slave piston, and a feed passage 330 that provides communication between the indent and the recess. The lower end 340 of the slave piston 300 may be adapted to contact an engine valve or contact stem 600.

The elongated stop 400 may be cylindrically shaped with a non-fluted end 410 (threaded as shown in FIG. 5), and a fluted end 420. An elongated stop shoulder 430 is formed at the intersection of the non-fluted end 410 and the fluted end 420. When threaded as shown, the non-fluted end 410 may be screwed into the housing 700 to a preselected depth. The extension of the fluted end 420 into the housing 700 may be adjusted by backing out or twisting in the elongated stop 400 relative to the housing. The fluted end 420 extends into the slave piston recess 320 when the slave piston 300 is in its retracted position.

The fluted end 420 includes one or more flutes 422 which provide a means for guiding hydraulic fluid to and from the chamber 740. The flutes 422 may be of a uniform or non-uniform depth along the length of the fluted end 420. In a preferred embodiment of the invention, the flutes 422 are tapered to have a progressively decreased depth as the flutes near the non-fluted end 410. The taper is shown as linear, but may be non-linear to accomplish the desired seating velocity in alternative embodiments.

The disk 500 is provided with a central bore adapted to receive the fluted end 420 of the elongated stop 400. The diameter of the central bore is selected relative to that of the fluted end 420 so that a minimum flow area may be formed between the fluted end and the disk 500. The disk 500 may be biased towards the upper end of the slave piston 300 by a spring 510.

With continued reference to FIG. 5, the system 100 may be operated starting from the position shown, in which the slave piston 300 is retracted. In order to displace the slave piston 300 downward for a valve opening event, pressurized hydraulic fluid is provided through the fill/drain port 720 to the housing bore 710. The hydraulic fluid flows around the peripheral indent 310 and through the feed passage 330 into the recess 320. As hydraulic pressure builds in the recess 320, the disk 500 may be displaced slightly upward against the bias of spring 510, allowing the chamber 740 to also fill with hydraulic fluid. After the recess 320 and the chamber 740 are filled with hydraulic fluid, the addition of still more hydraulic fluid to the recess 320 forces the slave piston 300 downward. As the slave piston 300 moves downward, the disk 500 follows the slave piston under the influence of the spring 510. The disk 500 does not cut off hydraulic communication between the recess 320 and the chamber 740 because the flutes 422 on the elongated stop permit hydraulic fluid to flow past the disk 500 as it slides down the stop. The downward motion of the slave piston 300 causes the engine valve or contact stem 600 to open against the bias of a valve spring (not shown).

In an alternative embodiment of the present invention, the slave piston 300 shown in FIG. 5 may simply follow the engine valve/contact stem 600 as it moves downward in response to a separate valve opening means (not shown).

Following the valve opening event, the engine valve must be returned gently to its seat during a valve closing event. In order to close the valve, the hydraulic fluid must be drained from the chamber 740. The hydraulic fluid may be drained back through the feed passage 330 and out of the fill/drain port 720. As the hydraulic fluid is drained, the slave piston 300 retracts. The upper end of the retracting slave piston 300 engages the disk 500, and pushes the disk up along the fluted end 420 of the elongated stop. As the disk 500 travels towards the bore end wall 712, the hydraulic fluid in the chamber 740 escapes to the recess 320 through the open space between the flutes 422. This open space decreases to the point of being just the annular clearance at the tapered portion of the flutes 422. As the open space decreases, the rate of hydraulic fluid flow from the chamber 740 to the recess 320 decreases in like proportion. The progressively decreased drain or flow of hydraulic fluid from the chamber 740 as a result of the disk 500 riding up the fluted end 420 of the elongated stop brings the slave piston 300 ( and thus the engine valve) to a soft landing against the elongated stop 400.

Figure 6:
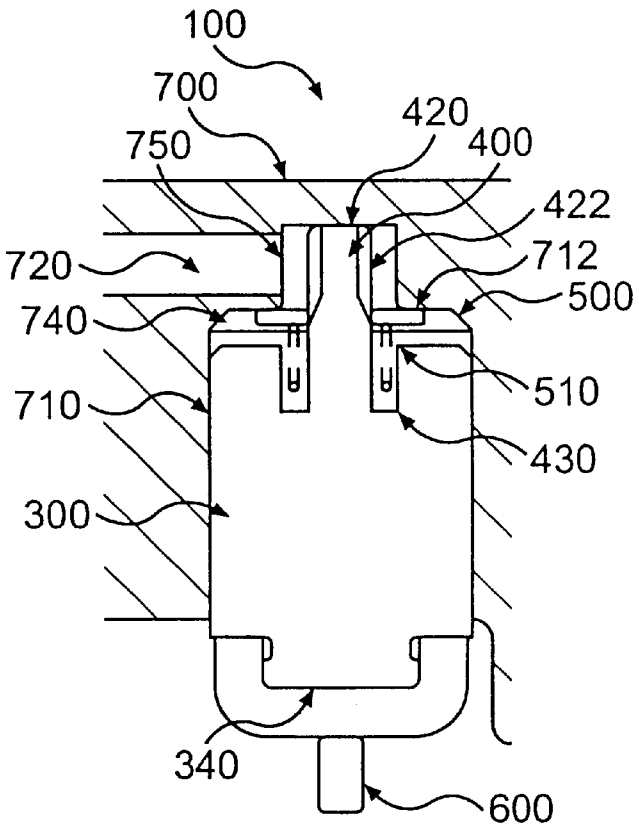
FIG. 6 is a cross-section in elevation of a fourth embodiment of the present invention.

With reference to FIG. 6, in which like reference numerals refer to like elements, a fourth embodiment of a system 100 for valve actuation and valve seating control is shown. In the embodiment shown in FIG. 6, the fluted end 420 of the elongated stop is integrally formed with the body of the slave piston 300. Instead of providing a recess in the slave piston 300, a recess 750 is provided in the end wall 712 of the housing 700. The recess 750 receives the fluted end 420 of the elongated stop 400 when the slave piston 300 is in a retracted position. The spring 510 biases the disk 500 towards the end wall 712. The fill/drain passage 720 provides and drains hydraulic fluid directly to the recess 750 without passing through a feed passage in the slave piston 300. Valve seating is accomplished in the same manner in the embodiments of the invention shown in FIGS. 5 and 6. As the slave piston approaches its fully retracted position, the relative movement of the tapered end of the flutes 422 past the disk 500 throttles the flow of hydraulic fluid from the chamber 740 to the recess 750 more and more until the flow is reduced to zero and the valve seats.

Figure 8:
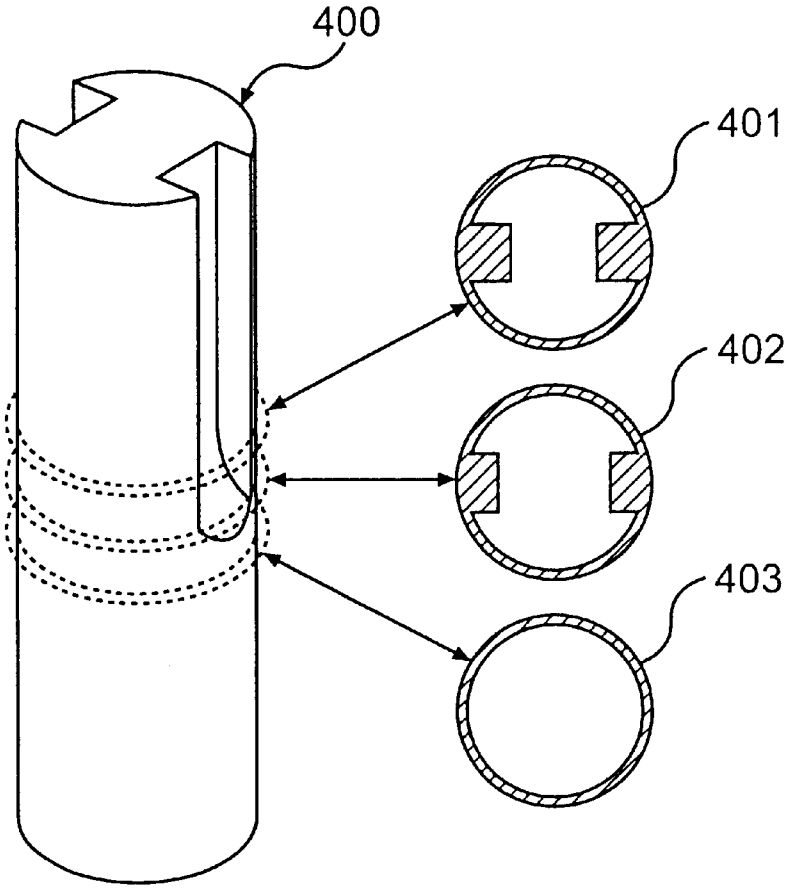
FIG. 8 is a pictorial view of an elongated stop or control pin with two flutes implemented as grooves for use in an embodiment of the present invention.
Figure 10:
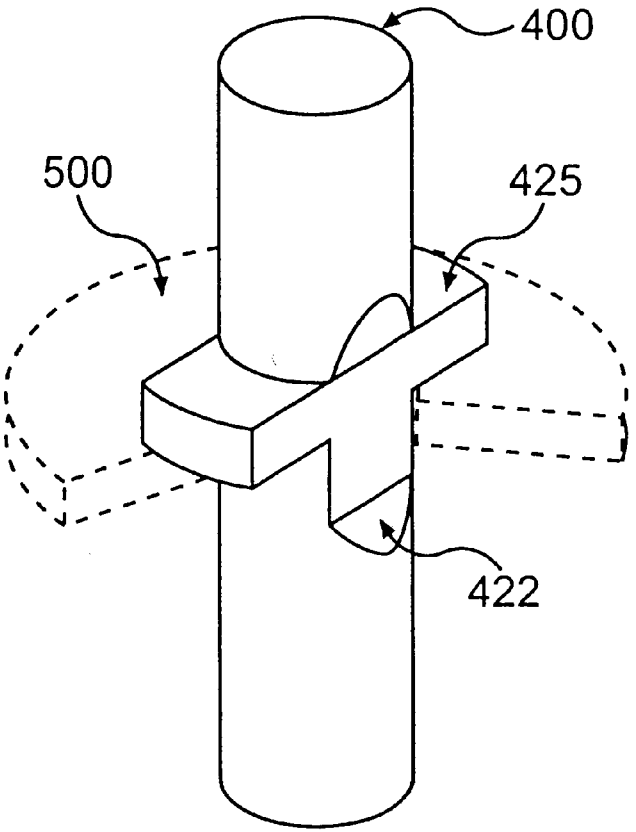
FIG. 10 is a pictorial view of a another means of limiting the motion of the check disk relative to the control pin for use in an embodiment of the present invention.

With reference to FIGS. 7 and 8, in which like reference numerals refer to like elements in the other drawing figures, the operative engagement of the disk 500 and the fluted end 420 of an elongated stop 400 is illustrated. In these embodiments of the invention, the flutes 422 are of non-uniform depth, and have a non-linear taper. The movement of the disk 500 along the longitudinal axis of the elongated stop 400 towards the tapered end of the flutes produces progressive throttling of the hydraulic fluid flow between the disk and the elongated stop. The progression of throttling, which is proportional to the decrease in flow area, is apparent from progressive illustration of flow area (shown shaded) in FIGS. 7 and 8. The sequence illustrates the decrease in flow area between the disk 500 and the elongated stop 400 as the disk moves downward on the elongated stop. This reduction in area may extend down to just the annular clearance between the elongated stop 400 and the disk 500 as shown in FIGS. 7 and 8. Limiting the travel of the disk 500 relative to the elongated stop 400 allows for a more compact design because it eliminates the need to size the maximum flute area 401 in FIGS. 7 and 8 for unrestricted valve closing. This pertains to the embodiments in FIGS. 3–6 and 11–12. Several possible means for limiting the travel of the disk are shown in FIGS. 9 and 10. FIG. 9 shows a cap 425 which is crimped onto the fluted end 420 of the elongated stop. FIG. 10 shows the stop 425 as a feature on the elongated stop 400. In the embodiment of FIG. 10, the elongated stop assembly could be fabricated from a central pin, which is upset to form the flute and disk retention stop, and a cylindrical sleeve, which is swaged onto the central pin after assembling the disk and disk spring on the central pin.

Figure 12:
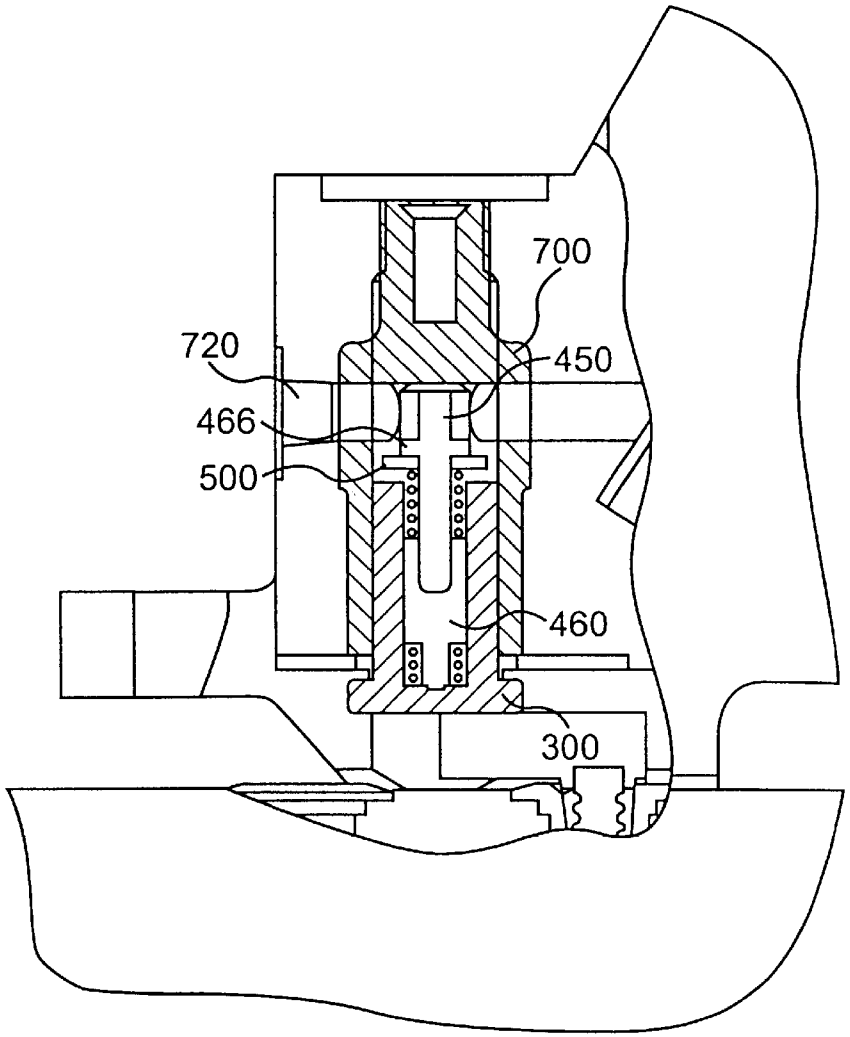
FIG. 12 is a second cross-section in elevation of the valve catch shown in FIG. 11.
Figure 11:
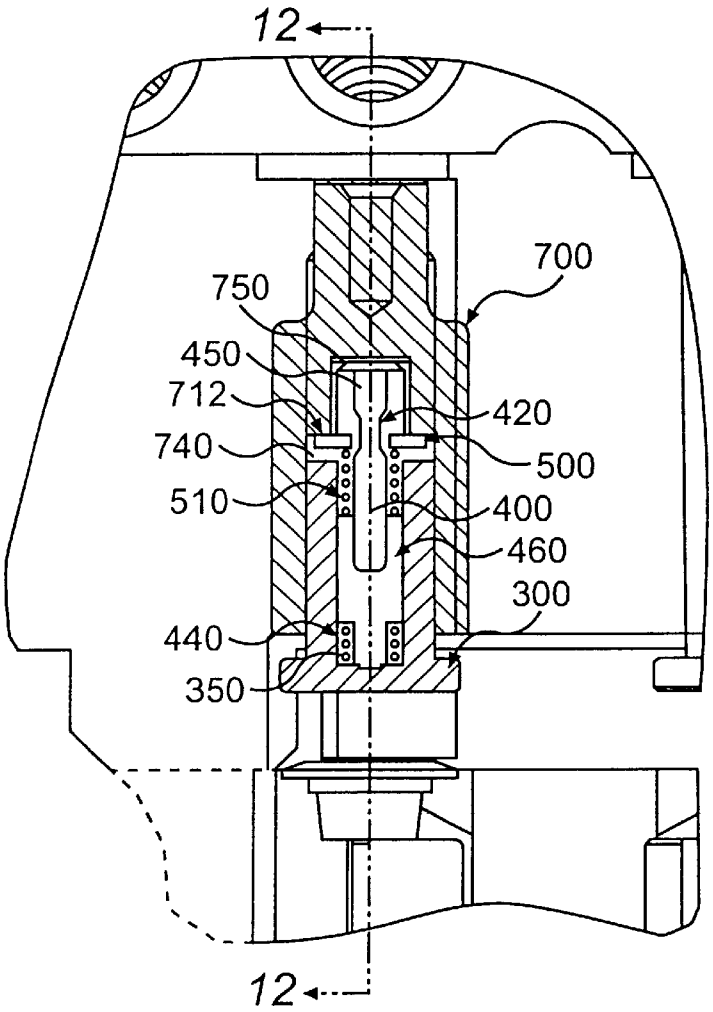
FIG. 11 is a cross-section in elevation of a fifth embodiment of the present invention.
Figure 13:
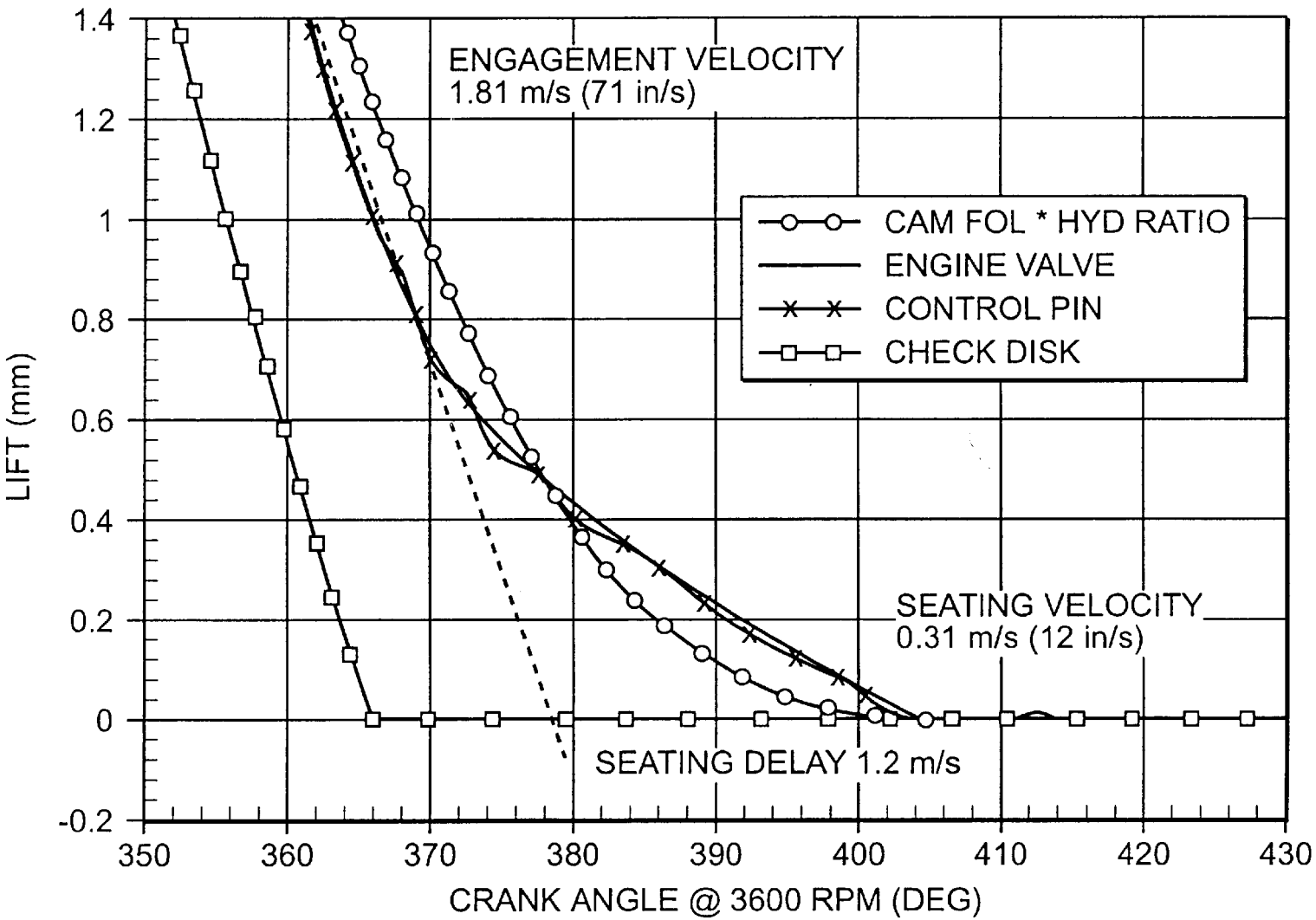
FIGS. 13–16 are graphs that illustrate operational parameters of the fifth embodiment of the present invention.
Figure 14:
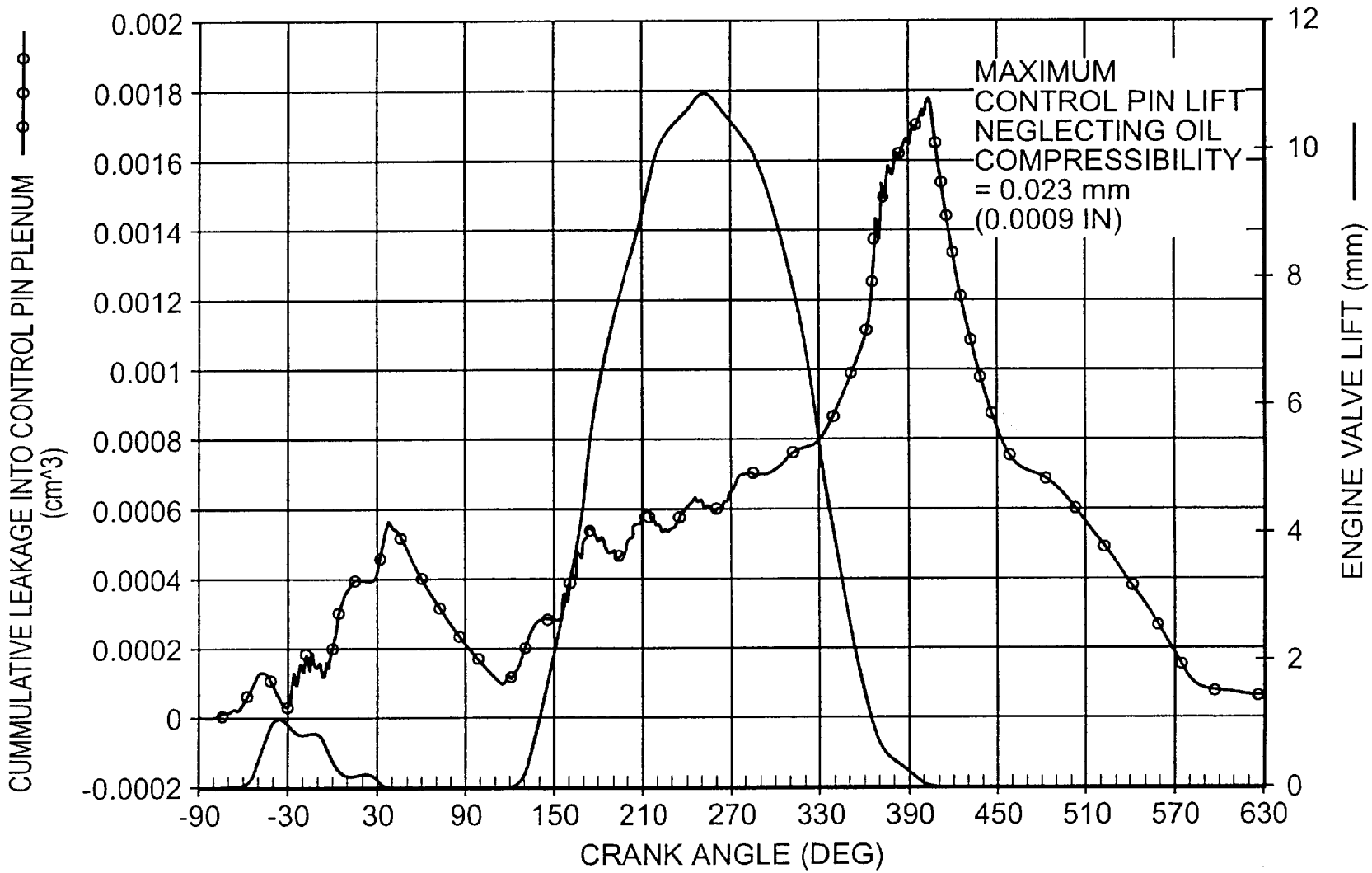
Figure 15:
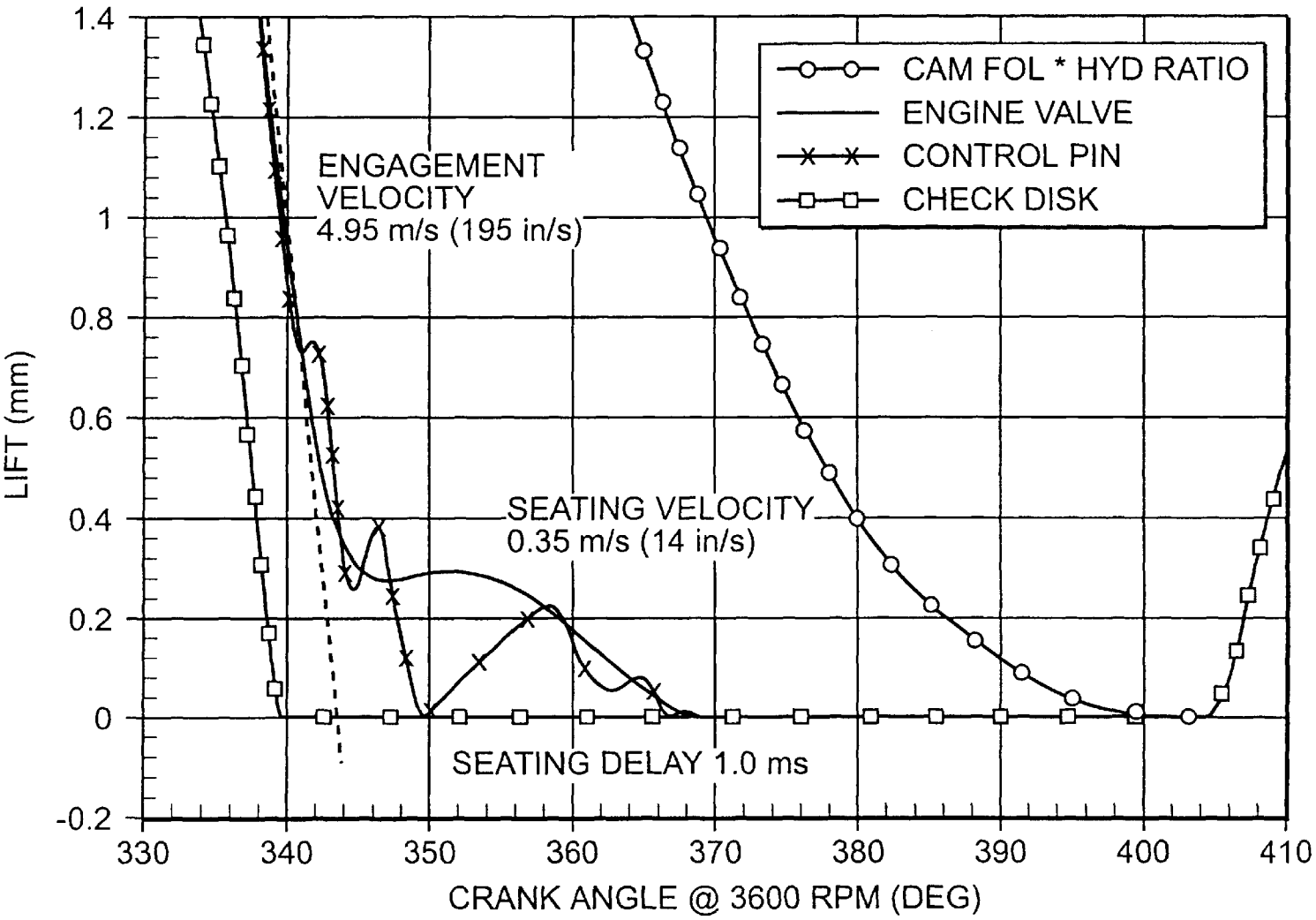
Figure 16:
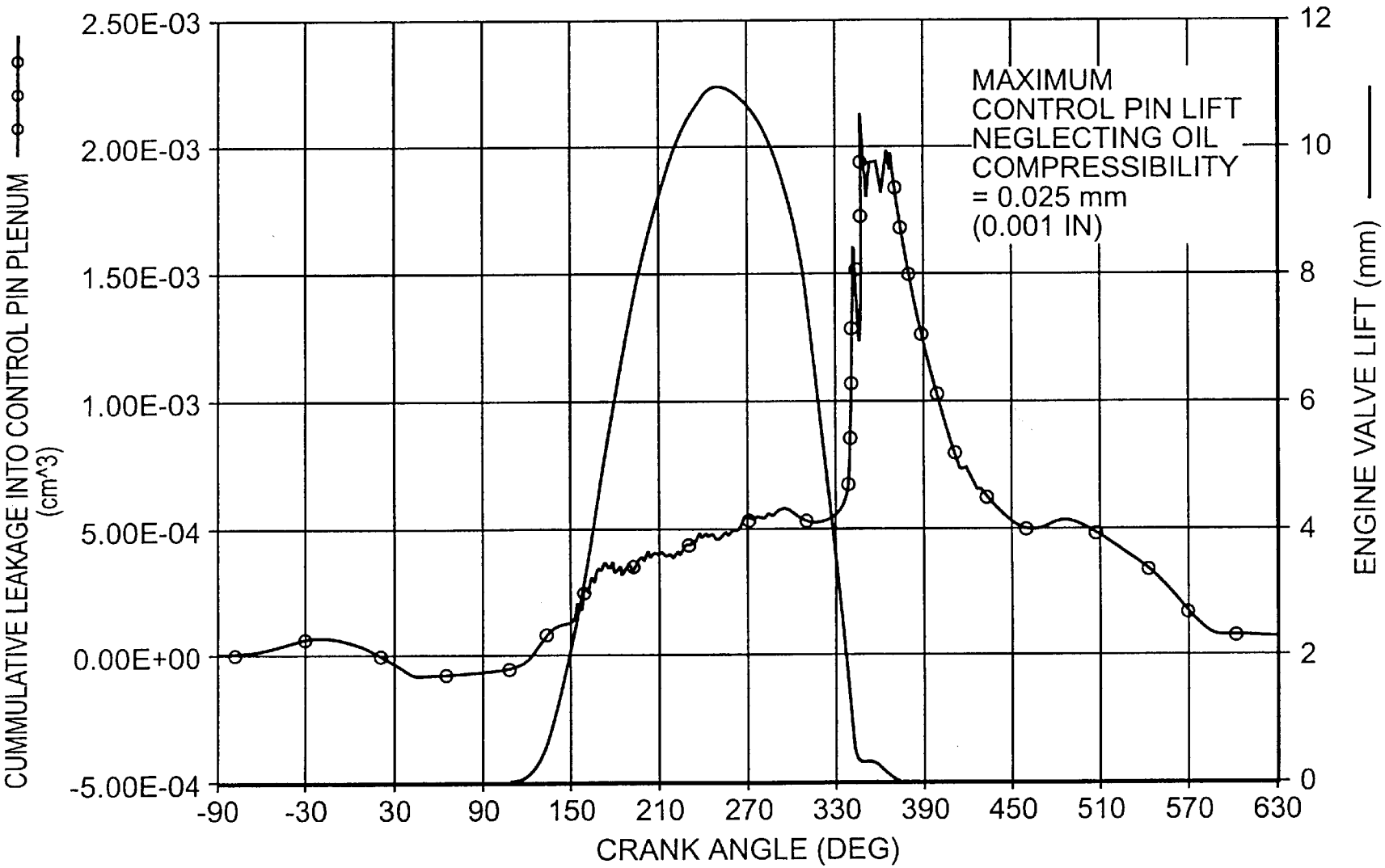

With reference to FIGS. 11 and 12, in which like reference numerals refer to like elements in the other drawing figures, a fifth embodiment of the valve catch portion of the present invention is illustrated. FIG. 11 is a cross-section in elevation of the system 100, which includes a cut line. FIG. 12 is a cross-section in elevation of system 100 as viewed along the cut line in FIG. 11. In the fifth embodiment, the system 100 is similar to that described in relation to FIG. 3, with the following differences.

The elongated stop 400 shown in FIGS. 11 and 12 is configured differently than in FIGS. 3–6. The elongated stop comprises two separate pieces to facilitate assembly, an upper stop 450 and a lower stop 460. The upper stop 450 includes a plurality of flutes in fluted section 420, and two bosses 466. The bosses 466 limit the upward movement of the disk 500 relative to the elongated stop 400. The fluted section 420 of the upper stop 450 controls the flow of the hydraulic fluid between the chamber 740 and the recess 750. The bosses 466 may prevent the disk 500 from coming off the end of the stop 400. The bosses 466 may also hold the disk 500 off of the seat when piston 300 is at high lift, thereby providing additional flow area from chamber 740 to the recess 750.

FIGS. 13–16 are graphs that illustrate the operational parameters of the embodiment of the invention shown in FIGS. 11 and 12. The data provided in FIGS. 13–16 is not intended to limit the invention in any way. It is understood that the operational parameters of the various embodiments of the invention may vary widely without departing from the scope of the invention.

Figure 17:
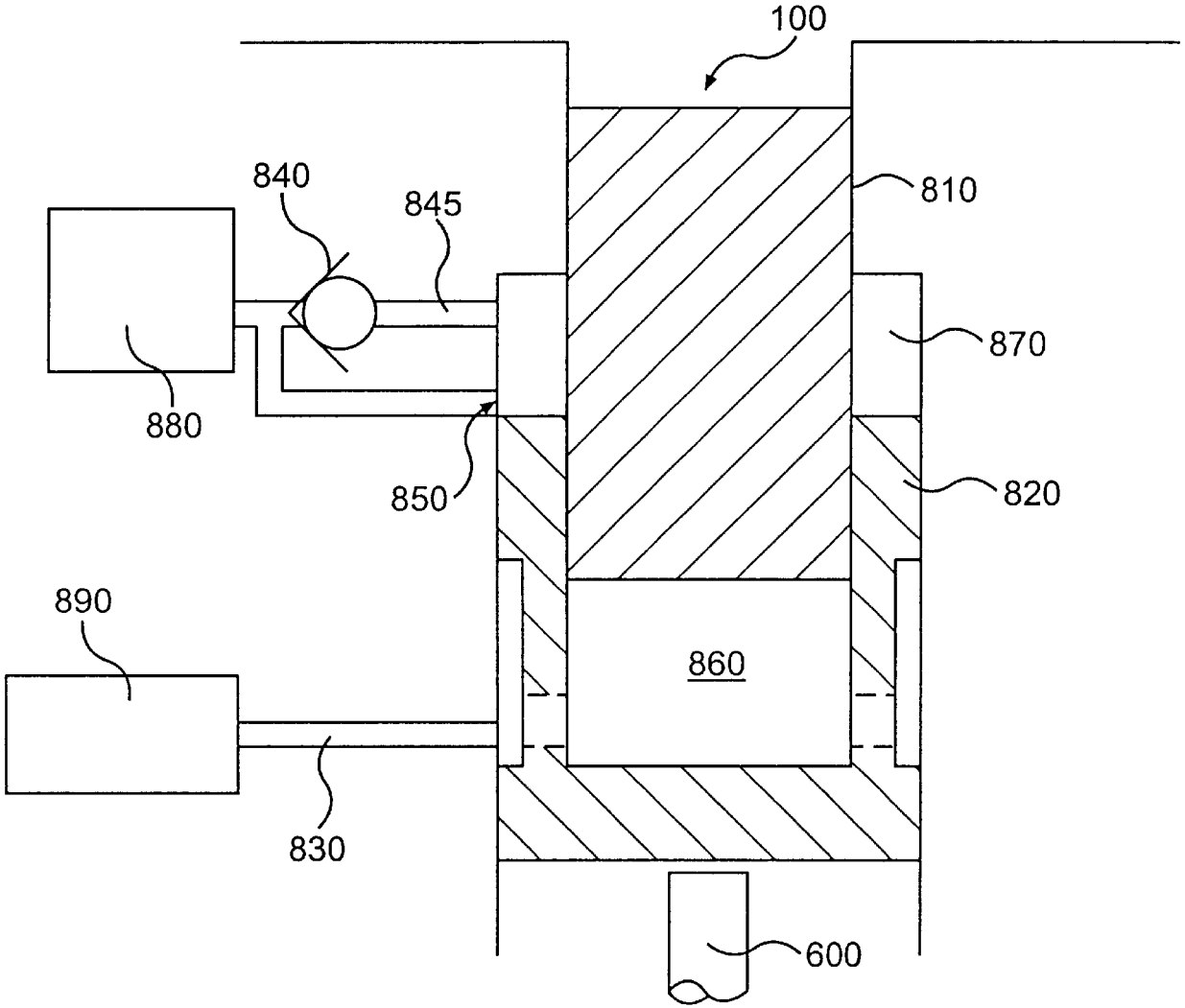
FIG. 17 is a cross-section in elevation of a sixth embodiment of the present invention.

A sixth embodiment of the valve catch portion of the present invention is shown as system 100 in FIG. 17. The system 100 may include an inner tappet 810, an outer tappet 820, an hydraulic fluid line 830 extending from a trigger accumulator 890 to an inner tappet plenum 860, a check valve 840 in an hydraulic circuit 845 connecting a low pressure reservoir 880 with the valve seating plenum 870, a partially occludable orifice 850 located at a juncture of the valve seating plenum 870 and the hydraulic circuit 845, and an inter-tappet plenum 860.

During engine valve opening, both the inner tappet 810 and the outer tappet 820 may move downward following the engine valve. During this time the valve seating plenum 870 may be filled with hydraulic fluid through the check valve 840 and the orifice 850. The flow through the check valve 840 may be required to prevent cavitation in the valve seating plenum 870 because the orifice 850 is designed to be partially occluded at this point.

As the engine valve closes (i.e. element 600 moves upward), the check valve 840 closes and hydraulic fluid is forced through the partially occluded orifice 850 from the valve catch plenum 870 back to the low pressure reservoir 880. The partially occluded orifice 850, formed by the upper edge of the outer tappet 820 and the hole in the side wall of the plenum 870, is designed to progressively restrict the flow of hydraulic fluid from the plenum 870 as the engine valve approaches its seat. The ideal orifice flow area profile would maintain a constant valve catch plenum pressure between the point at which the orifice starts to occlude, at typically, but not limited to, 1 mm engine valve lift, to the point of valve seating.

The system 100 shown in FIG. 17 may also be used to provide VVA in an alternative embodiment. In a VVA embodiment, the inner tappet 810 is displaced by a valve train element such as a cam (not shown). The outer tappet 820 follows the engine valve/contact stem 600. Variable valve timing may be achieved by opening the trigger valve 890, which permits the flow of oil from the inter-tappet plenum 860. Automatic lash take up may be provided by a device (not shown) located between the outer tappet 820 and element 600.

Figure 18:
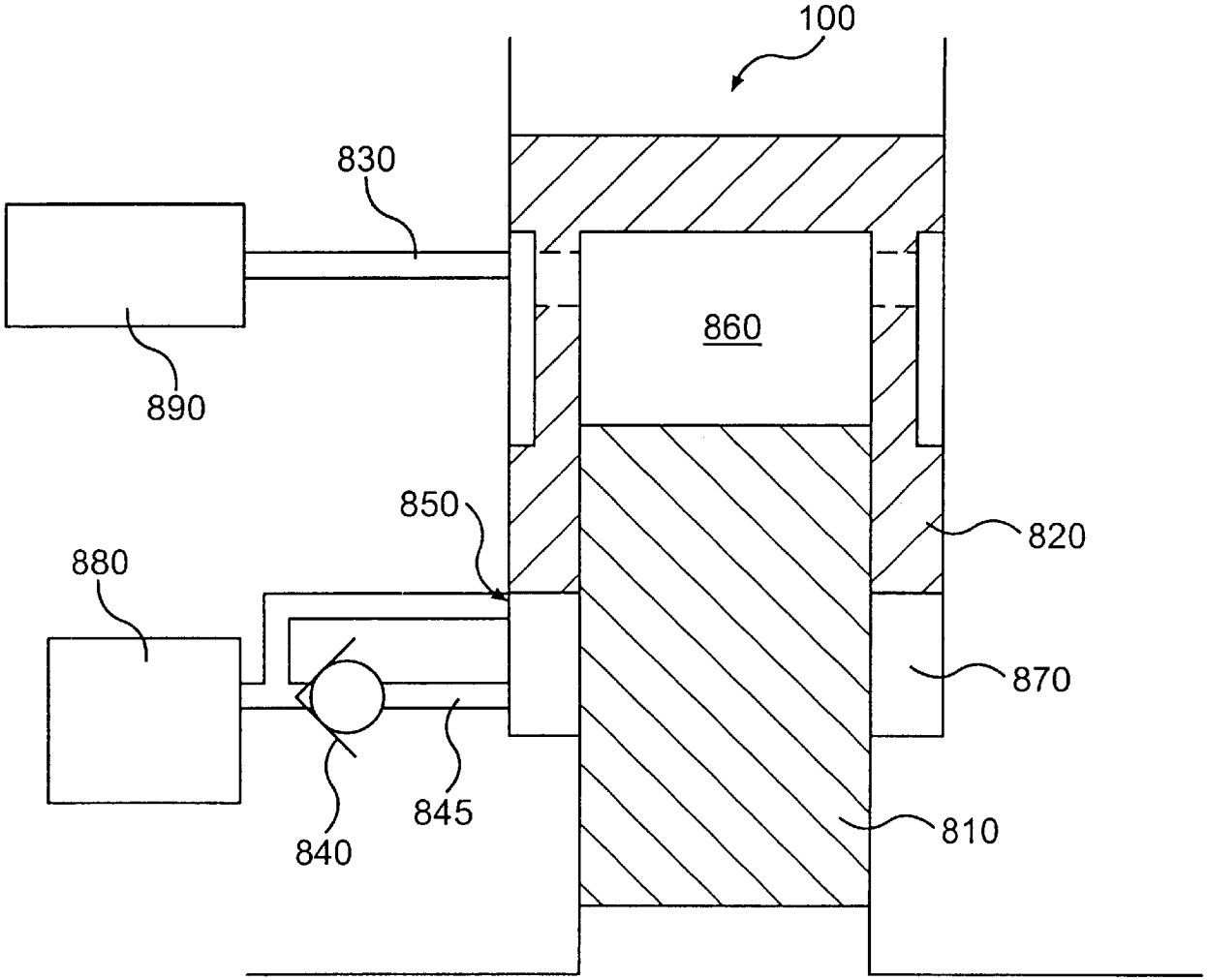
FIG. 18 is a cross-section in elevation of a seventh embodiment of the present invention.

With reference to FIG. 18, the design shown in FIG. 17 may be adapted to reside on the push-tube side of a rocker in a cam-in-block engine design. The assembly shown in FIG. 18 is essentially a flipped over version of the assembly shown in FIG. 17. In FIG. 18, the outer tappet is on the engine valve side of the valve train and the inner tappet is on the cam side of the valve train. The operation of the assembly shown in FIG. 18 is the same as that for the assembly shown in FIG. 17.

Figure 20:
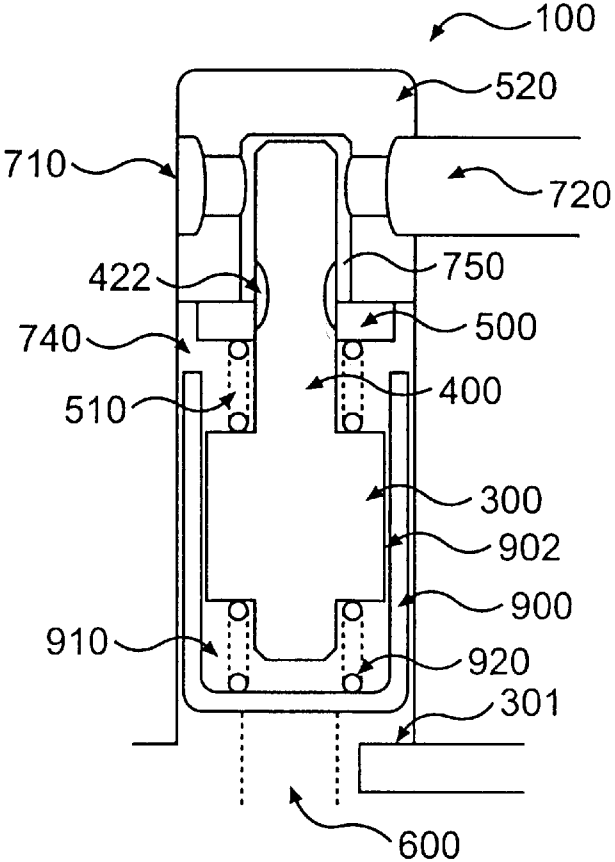
FIG. 20 is a cross-section in elevation of a ninth embodiment of the present invention.
Figure 19:
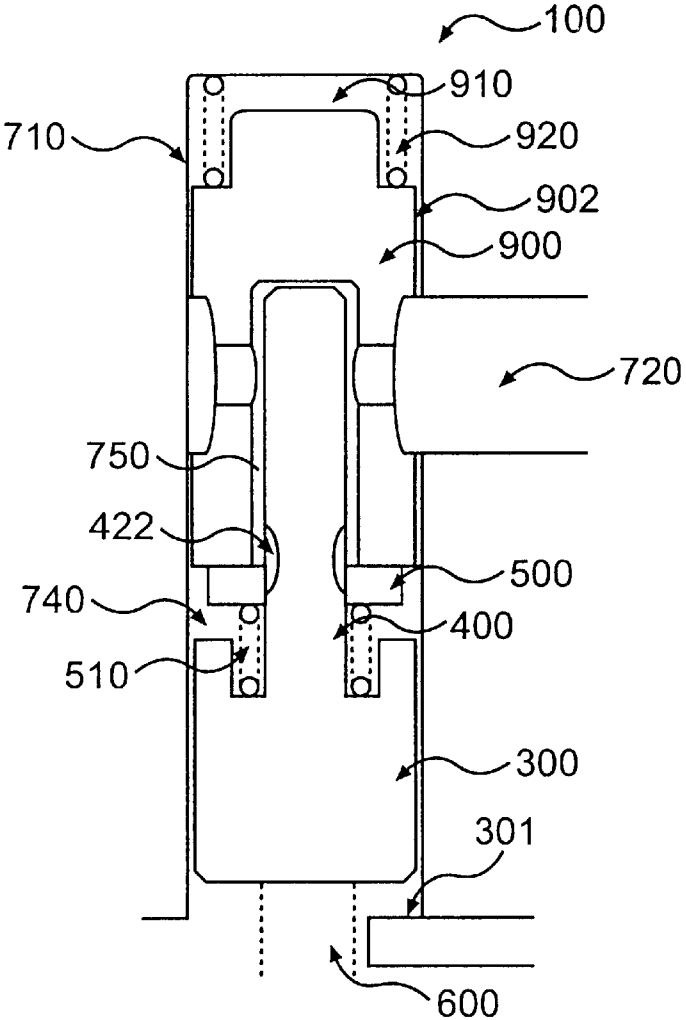
FIG. 19 is a cross-section in elevation of an eighth embodiment of the present invention.

FIGS. 19 and 20 show two different embodiments of the invention in which like reference numerals refer to like elements shown in the other figures. In both FIGS. 19 and 20, the valve stem or follower end 600 is shown in its rest position with the engine valve against its seat.

FIG. 19 shows a lash adjustment piston 900 located above the elongated stop 400. The elongated stop 400 is integrally formed with the seating piston 300. Low pressure oil from the supply duct 720 leaks past the lash piston clearance 902 into the lash chamber 910, pushing the lash piston 300 against the stop 400 which in turn contacts the valve/follower end 600. The lash piston 900 may also be biased downward by a lash spring 920.

When the engine valve lifts off its seat due to the action of the follower, oil will flow past the check disk 500 and push the seating piston 300 down against its maximum travel stop 301. During the time the engine valve is off of its seat, some oil will leak through clearance 902 and cause the lash piston 900 to move down following the stop 400. This controlled leakage is small enough that it has no effect during the time that the engine valve is open (on the order of milliseconds). When the engine valve returns and approaches its seat, the valve/follower end 600 will contact the seating piston 300 and push it upward. The upward travel of the seating piston 300 is controlled by the oil flow through the clearance between the stop 400, the inside diameter of the check disk 500, and the flow through the flow control channels 422. The varying nature of these flow areas causes the engine valve to approach its seat at a controlled velocity. In between valve events oil will leak in or out of the lash chamber 910 through the clearance 902 at a rate fast enough to adjust for any changes in valve length due to thermal growth (tens of seconds) and component wear (months).

FIG. 20 shows an embodiment of the invention similar to that shown in FIG. 19 where the lash piston 900 (shown as a shell) is located below the seating piston 300. Oil from the supply duct 720 enters through a stationary check disk seat 520. In all other aspects, the components in FIG. 20 act the same as those in FIG. 19.

Figure 22:
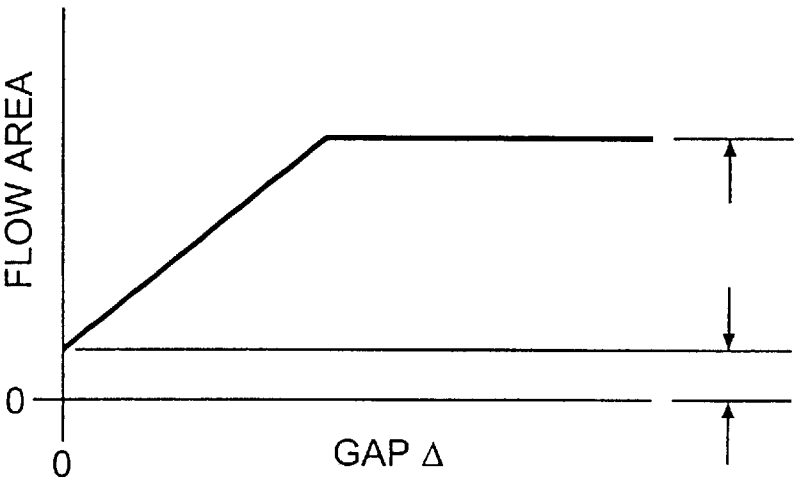
FIG. 22 is a graph of disk flow area verses slave piston to disk gap for the arrangement shown in FIG. 21.
Figure 21:
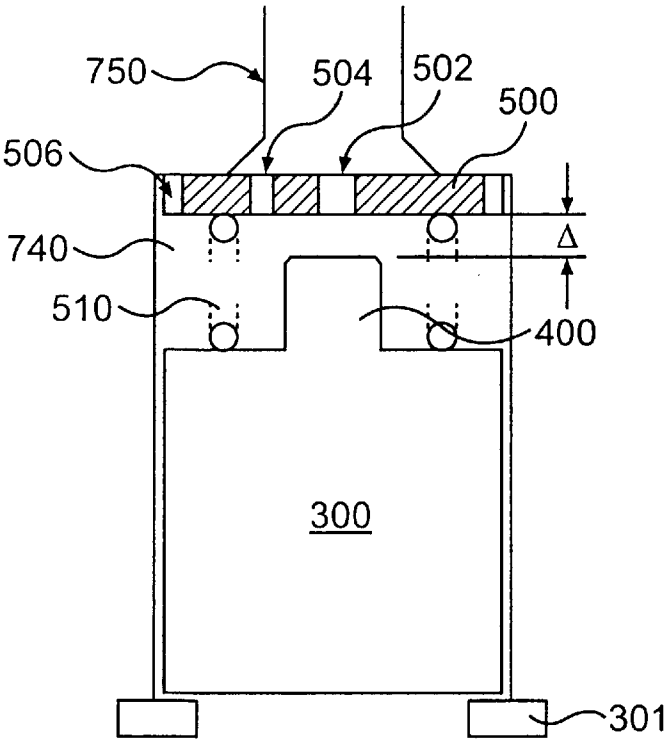
FIG. 21 is a cross-section in elevation of an alternative slave piston and check disk arrangement for use in the systems shown in FIGS. 19–20.

FIG. 21, in which like reference numerals refer to like elements, shows an alternative seating piston 300 and check disk 500 arrangement that can be used in the systems 100 shown in FIGS. 19 and 20. The disk 500 includes a central flow opening 502, an off-set flow opening 504, and a bore alignment feature 506. The progressive occlusion of the central opening 502 provides the required throttling for valve seating. FIG. 22 shows the flow area past the check disk 500 as a function of the separation (Δ) of the seating piston 300 and the disk.

Figure 23:
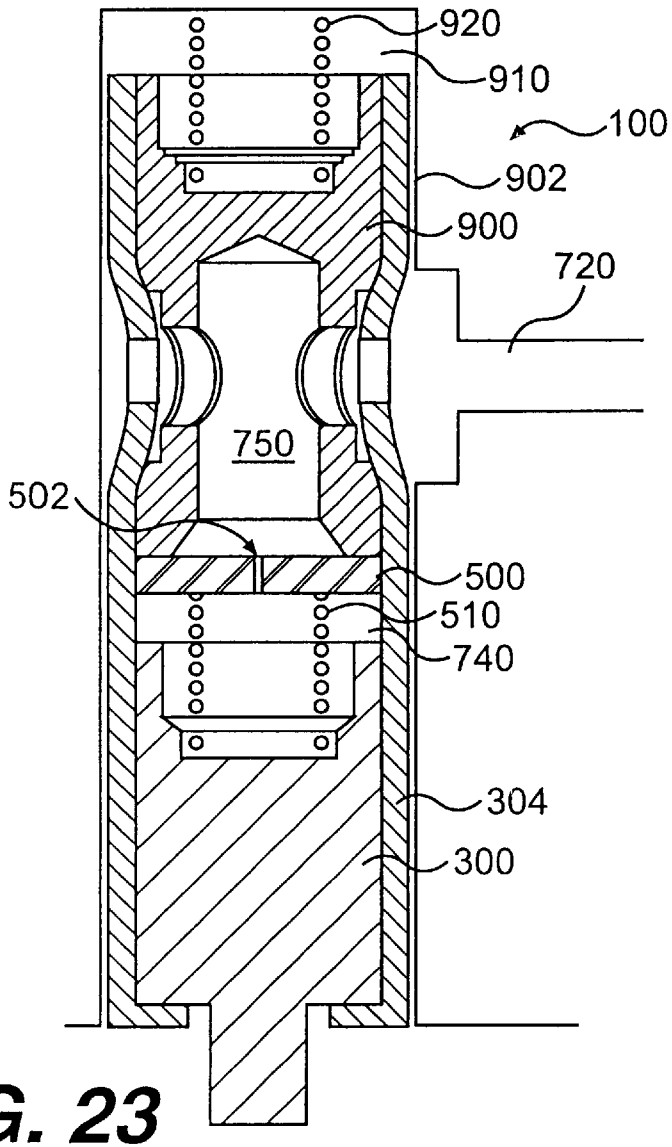
FIG. 23 is a cross-section in elevation of a tenth embodiment of the present invention.
Figure 25:
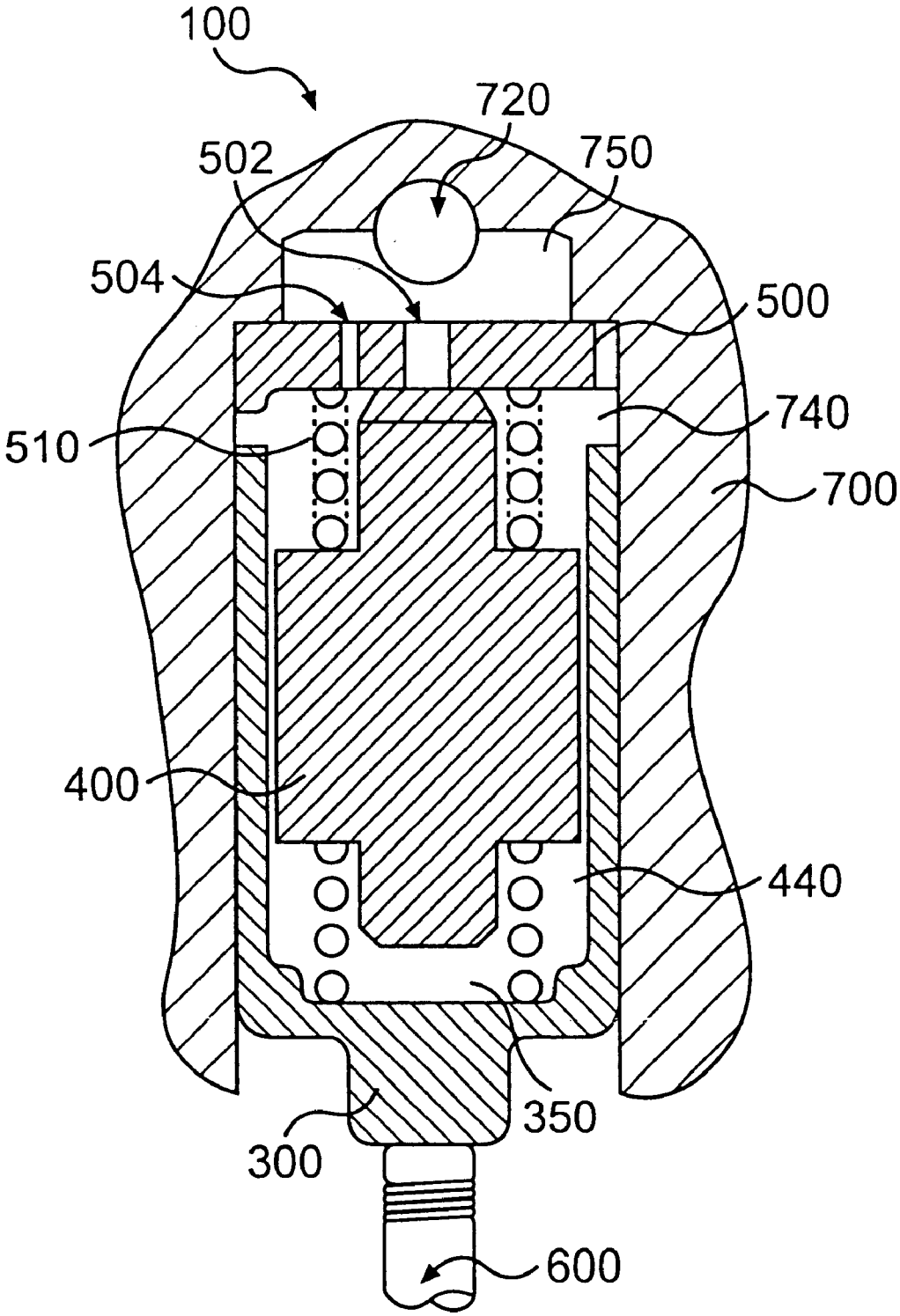
FIG. 25 is a cross-section in elevation of a twelve embodiment of the present invention illustrating and adaption of the slave piston and check disk arrangement of FIG. 21 for use in the system shown in FIG. 3.

FIG. 23 shows an alternative seating piston 300 and check disk 500 arrangement to that shown and described in connection with FIG. 24. FIG. 23 shows a one piece or self-contained version of FIG. 19. In this version the stroke of the seating piston 300 is not affected by lash adjustment. Automatic lash take up is provided by the flow of leakage oil to the lash chamber 910. Leakage flow to the chamber 910 causes the entire assembly packaged within the tube 304 to move downward and take up any lash.

With continued reference to FIG. 23, valve seating velocity occurs as a result of seating the check disk 500 against an upper seat. The check disk 500 is provided with a constant orifice 502. Fluid flow may also occur around the outer perimeter of the check disk 500 as a result of alignment feature 506. The flow past the alignment feature 506 is throttled as the disk 500 approaches its upper seat during engine valve closing.

Figure 24:
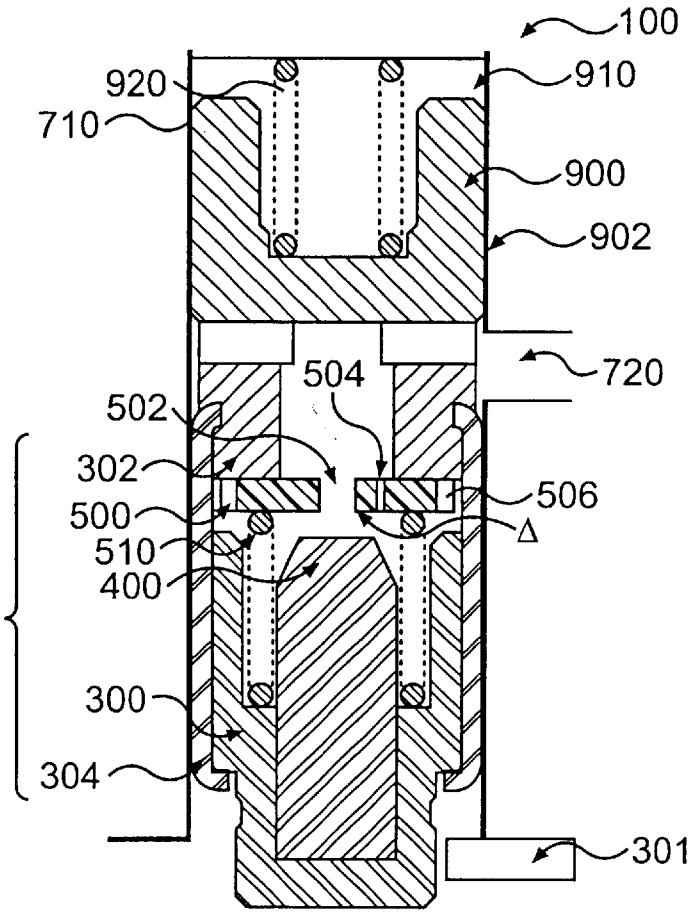
FIG. 24 is a cross-section in elevation of an eleventh embodiment of the present invention.

FIG. 24 shows a two-piece construction with the lash adjustment piston 900 separate from the valve seating piston assembly 300. The seating piston assembly 300 includes a disk seat member 302 and a tube 304. This is primarily a manufacturing concern, but the two separate pistons may permit two different diametrical clearances. The lash adjustment piston 900 may be closely fit within the bore 710 to prevent excess leakage of the high pressures generated during valve seating. The seating piston assembly 300 may have a much larger clearance in the bore 710 to generate sufficient cooling flow around the outside of the seating piston tube 304 when supplied by the low pressure oil source 720. The internal clearance between the seating control piston lower member 306 and the tube 304 is similar to that of the lash piston since it experiences similar pressures. This form of cooling is self regulating. As the oil becomes hotter its viscosity becomes lower and the leakage flow around the tube 304, and therefore cooling, is increased. The two piece design will separate during engine valve lift. During engine valve closing, the seating piston assembly 300 moves back toward the lash piston 900 and then the elongated stop 400 will regulate the valve seating velocity. This hardware is shown with a central hole 502 in the check disk 500 that is covered by the end of the elongated stop 400 to regulate the flow area past the disk 500. In some designs the off-center hole 504 is not required and the disk 500 has only the central hole 502. A fluted elongated stop passing through the check disk could be used as illustrated in the previous designs.

Furthermore, it will be apparent to those skilled in the art that various modifications and variations can be made in the construction, configuration, and/or operation of the present invention without departing from the scope or spirit of the invention. For example, the shape, size, width, depth, and length of the fluted end of the elongated stop, and the flutes themselves, may be varied to achieve a particular hydraulic fluid flow profile suitable for a particular engine valve arrangement. Furthermore, the number of flutes on the elongated stop may also be varied to achieve a particular fluid flow profile. Still further, it is appreciated that the references throughout the specification to a slave piston encompass a piston other than that used in a traditional master-slave system, and in fact include all pistons whether used in lost motion systems or not. Thus, it is intended that the present invention cover the modifications and variations of the invention provided they come within the scope of the appended claims and their equivalents.

What is claimed:

1. An engine valve seating system having a piston adapted to be bi-directionally displaced in response to the filling and draining of hydraulic fluid from an hydraulic chamber in communication with said piston, said system comprising:

means for guiding hydraulic fluid from said chamber during draining; and means for throttling hydraulic fluid flow through the guiding means at a preselected rate in response to a change in position of the guiding means relative to the throttling means during draining, wherein the throttling means includes a central bore, and the guiding means includes a surface adapted to selectively occlude the central bore.

2. The system of claim 1 wherein said piston is a slave piston in a lost motion valve actuation system of an internal combustion engine, and said means for guiding and means for throttling collectively comprise a velocity control device that provides a restriction in hydraulic fluid flow from said chamber during a closing stroke of an engine valve operatively connected to said slave piston to thereby limit seating velocity of the engine valve.

3. The system of claim 1 wherein said throttling means comprises a disk, said disk being positioned in said chamber, and said disk having a central bore adapted to receive said guiding means.

4. The system of claim 1 wherein said guiding means comprises an elongated stop having at least one flute formed along a sidewall of said stop, and wherein said throttling means comprises a disk having a central bore adapted to slidingly receive said elongated stop.

5. The system of claim 1 further comprising a spring positioned between said throttling means and a shoulder formed on said guiding means.

6. The system of claim 1 further comprising a spring positioned between said throttling means and a shoulder formed on said piston.

7. The system of claim 6 further comprising a spring positioned between said piston and a shoulder formed on said guiding means.

8. The system of claim 1 further comprising a recess in said piston adapted to receive said guiding means.

9. The system of claim 1 further comprising a housing in which the chamber is formed, wherein said guiding means is adjustably extended through the housing into the chamber.

10. The system of claim 9 wherein said guiding means is adjustably connected to said housing by cooperating screw threads formed on the guiding means and the housing.

11. The system of claim 1 further comprising means for automatically taking up lash between said system and an engine valve component.

12. The system of claim 1 wherein said throttling means comprises a pin shaped end formed on said piston, said pin shaped end being adapted to progressively occlude a flow opening.

13. The system of claim 12 wherein said guiding means comprises a disk, said disk being positioned in said chamber, and said disk having a central flow opening adapted to be progressively occluded by the throttling means and an off-center flow opening adapted to remain unoccluded.

14. The system of claim 1 wherein said means for guiding and means for throttling collectively comprise a velocity control device that provides a restriction in hydraulic fluid flow from said chamber during a closing stroke of an engine valve operatively connected to said piston to thereby limit seating velocity of the engine valve.

15. An engine valve seating system having a piston adapted to be bi-directionally displaced in response to the filling and draining of hydraulic fluid from an hydraulic chamber in communication with said position, said system comprising:

means for guiding hydraulic fluid from said chamber during draining; and means for throttling hydraulic fluid flow through the guiding means at a preselected rate in response to a change in position of the guiding means relative to the throttling means during draining;

wherein said guiding means comprises an elongated stop having at least one flute formed along a sidewall of said stop.

16. The system of claim 15 wherein said elongated stop includes a plurality of flutes formed along a sidewall thereof.

17. The system of claim 15 wherein said flute is of a non-uniform depth.

18. The system of claim 15 wherein said flute includes a tapered top end.

19. The system of claim 18 wherein said taper is linear.

20. The system of claim 18 wherein said taper is non-linear.

21. The system of claim 15 further comprising a cap connected to an end of the elongated stop.

22. An engine valve seating system having a piston adapted to be bi-directionally displaced in response to the filling and draining of hydraulic fluid from an hydraulic chamber in communication with said piston, said system comprising:

means for guiding hydraulic fluid from said chamber during draining; and means for throttling hydraulic fluid flow through the guiding means at a preselected rate in response to a change in position of the guiding means relative to the throttling means during draining, further comprising a spring positioned between said piston and a shoulder formed on said guiding means.

23. An engine valve seating system having a piston adapted to be bi-directionally displaced in response to the filling and draining of hydraulic fluid from an hydraulic chamber in communication with said piston, said system comprising:

means for guiding hydraulic fluid from said chamber during draining; and means for throttling hydraulic fluid flow through the guiding means at a preselected rate in response to a change in position of the guiding means relative to the throttling means during draining, wherein said guiding means is adjustably connected to said piston by cooperating screw threads formed on the guiding means and on a threaded recess in the piston.

24. An engine valve seating system having a piston adapted to be bi-directionally displaced in response to the filling and draining of hydraulic fluid from an hydraulic chamber in communication with said piston, said system comprising:

means for guiding hydraulic fluid from said chamber during draining; and means for throttling hydraulic fluid flow through the guiding means at a preselected rate in response to a change in position of the guiding means relative to the throttling means during draining, wherein said guiding means and said piston are integrally formed.

25. A system for controlling seating velocity of an internal combustion engine valve comprising:

a housing having a bore formed therein for receipt of a piston;

a piston positioned in and adapted for bi-directional displacement in the bore;

an hydraulic chamber defined by an end of the piston;

a piston stop extending into the chamber; and a disk having at least a central opening, said disk positioned in the chamber and being adapted to cooperate with said piston stop to control valve seating velocity.

26. The system of claim 25 wherein said piston stop includes a fluted end, and wherein the system further comprises:

a housing recess formed in said housing for receiving the fluted end of the stop;

a housing recess shoulder framed along the intersection of the housing recess and the chamber; and means for biasing the disk against the housing recess shoulder when the piston is in a retracted position.

27. The system of claim 26 wherein said piston stop includes a fluted end and a non-fluted end, and wherein the system further comprises:

a piston recess for receiving the non-fluted end of the stop; and means for biasing the stop out of the piston recess.

28. The system of claim 27 wherein the means for biasing the stop comprises a spring.

29. The system of claim 27 wherein said non-fluted end of the stop and said piston recess are adapted to permit leakage fluid flow into said recess so as to provide automatic lash take up between the system and an engine valve component.

30. The system of claim 25 further comprising:

a piston recess formed in said piston for receiving a fluted end of said stop;

a piston recess shoulder formed along the intersection of the piston recess and the chamber; and means for biasing the disk against the piston recess shoulder when said piston is in a retracted position.

31. The system of claim 30 wherein the means for biasing the disk comprises a spring.

32. A system for controlling seating velocity of an internal combustion engine valve comprising:

a housing having a bore formed therein for receipt of a piston, and a recess formed in an end wall of the bore;

a recess shoulder formed along the intersection of the recess and the bore;

a piston positioned in and adapted for bi-directional displacement in the bore;

an hydraulice chamber defined by the bore end wall and the piston;

means for providing hydraulic fluid flow to and from the chamber;

a disk having at least a central opening, said disk positioned between the piston and the bore end wall;

a spring adapted to bias the disk against the recess shoulder when the piston is in a retracted position; and an elongated stop having a fluted end extending from the piston, through the chamber through the disk, and into the recess, wherein a minimized hydraulic passage is formed between the disk and the elongated stop when the piston is in the retracted position.

33. The system of claim 32 wherein the means for providing hydraulic fluid comprises an hydraulic passage communicating directly with the recess.

34. A system for controlling seating velocity of an internal combustion engine valve comprising:

a housing having a bore formed therein for receipt of a piston;

a piston positioned in and adapted for bi-directional displacement in the bore, said piston having a recess formed in an upper end thereof;

an hydraulic chamber defined by an end wall of the bore and the upper end of the piston;

a recess shoulder formed along the intersection of the recess and the chamber;

a disk having a central opening, said disk positioned between the piston and the bore end wall;

a spring adapted to bias the disk against the recess shoulder when the piston is in a retracted position; and an elongated stop having a fluted end extending from the bore end wall, through the chamber, through the disk, and into the recess, wherein a minimized hydraulic passage is formed between the disk and the elongated stop when the piston is in the retracted position.

35. The system of claim 34 further comprising an hydraulic passage communicating directly with the bore.

36. An engine valve seating system having an outer tappet adapted to be bi-directionally directionally displaced in response to the filling and draining of hydraulic fluid from an hydraulic chamber in communication with said outer tappet, said system comprising:

a housing having a bore formed therein for receipt of the outer tappet, said bore having an end wall;

an outer tappet disposed in the bore, said outer tappet being adapted to contact a valve train element, and having an end proximate to the bore end wall;

an hydraulic chamber formed between the bore end wall and the end of the outer tappet proximate to the bore end wall;

a hydraulic fill and drain passage communicating with the hydraulic chamber, said passage being adapted to be selectively occluded by displacement of the outer tappet in the bore.

37. An engine valve seating system comprising:

a housing having a bore formed therein;

means for supplying hydraulic fluid to the bore;

a lash adjustment piston disposed in the bore;

a seating piston disposed in the bore, said seating piston being spaced from the lash adjustment piston; and a disk disposed in the bore, said disk having a central opening adapted to be selectively occluded by said seating piston.

38. The system of claim 37 wherein the disk is disposed in a space between the lash adjustment piston and the seating piston.

39. The system of claim 37 wherein the disk is disposed in a space between the seating piston and an end of the bore.

40. The system of claim 39 further comprising:

a first spring disposed between the lash adjustment piston and the seating piston; and a second spring disposed between the seating piston and the disk.

41. The system of claim 37 further comprising a spring disposed between the lash adjustment piston and the seating piston.

42. The system of claim 41 further comprising a second spring disposed between the seating piston and the disk.

43. The system of claim 37 further comprising a spring disposed between the seating piston and the disk.

* * * * *